US010975582B2

(12) United States Patent
Kaiser et al.

(10) Patent No.: US 10,975,582 B2
(45) Date of Patent: Apr. 13, 2021

(54) UNCOUPLING STRIP

(71) Applicant: EWALD DÖRKEN AG, Herdecke (DE)

(72) Inventors: Uwe Kaiser, Herdecke (DE); Birgit Strieder, Bochum (DE); Heinz Peter Raidt, Dortmund (DE); Ulrich Goerke, Herdecke (DE); Thomas Bachon, Düsseldorf (DE)

(73) Assignee: EWALD DÖRKEN AG, Herdecke (DE)

( * ) Notice: Subject to any disclaimer, the term of this patent is extended or adjusted under 35 U.S.C. 154(b) by 0 days.

(21) Appl. No.: 16/605,089

(22) PCT Filed: Apr. 17, 2018

(86) PCT No.: PCT/EP2018/059724
§ 371 (c)(1),
(2) Date: Oct. 14, 2019

(87) PCT Pub. No.: WO2018/197256
PCT Pub. Date: Nov. 1, 2018

(65) Prior Publication Data

US 2020/0370307 A1 Nov. 26, 2020

(30) Foreign Application Priority Data

Apr. 26, 2017 (DE) ..... 10 2017 004 000.1

(51) Int. Cl.
*E04F 15/02* (2006.01)

(52) U.S. Cl.
CPC .... *E04F 15/02194* (2013.01); *E04F 15/0215* (2013.01)

(58) Field of Classification Search
CPC ..... E04F 15/0215; E04F 15/02194; E04F 15/182; E04F 15/185; E04F 15/186
See application file for complete search history.

(56) References Cited

U.S. PATENT DOCUMENTS 4,326,366 A * 4/1982 Werner ..... F24D 3/142 52/220.3
4,338,994 A * 7/1982 Hewing ..... F24D 3/141 165/49

(Continued)

FOREIGN PATENT DOCUMENTS

DE 29924180 U1 5/2002
DE 202012105080 U1 4/2014

(Continued)

OTHER PUBLICATIONS

International Search Report for International Application No. PCT/EP2018/059724, dated Jul. 17, 2018.

(Continued)

*Primary Examiner* — James M Ference
(74) *Attorney, Agent, or Firm* — Jason H. Vick; Sheridan Ross, PC

(57) ABSTRACT

A decoupling sheet (1) having a carrier plate (2) and a plurality of nubs (4) protruding from the carrier plate plane (3), wherein adjacent nubs (4) are arranged transversely to the lengthwise direction (5) and in the lengthwise direction (5) of the carrier plate (2). It is provided according to the invention that immediately adjacent nubs (4) transversely to the lengthwise direction (5) and in the lengthwise direction (5) of the carrier plate (2) have a nub base (10) of triaxial shape, especially with at least three leg sides (**6*b***).

19 Claims, 13 Drawing Sheets

(56) References Cited

U.S. PATENT DOCUMENTS 4,574,541 A * 3/1986 Raidt ..... E02D 31/02 52/169.5
4,576,221 A * 3/1986 Fennesz ..... F24D 3/14 165/49
5,619,832 A * 4/1997 Myrvold ..... E02D 31/02 52/403.1
5,965,235 A * 10/1999 McGuire ..... B29C 51/225 428/156
6,151,854 A * 11/2000 Gutjahr ..... E04D 13/0477 52/385
6,420,015 B1 * 7/2002 Nord ..... A47G 27/0231 264/293
6,434,901 B1 * 8/2002 Schluter ..... E02D 5/801 52/302.1
6,539,681 B1 * 4/2003 Siegmund ..... E04F 15/123 52/403.1
7,585,556 B2 * 9/2009 Julton ..... E04F 15/182 428/156
8,020,783 B2 * 9/2011 Backman, Jr. ..... F24D 3/142 237/69
8,176,694 B2 * 5/2012 Batori ..... E04F 15/185 52/220.2
8,684,277 B2 * 4/2014 Blanke ..... E04F 15/182 237/69
8,695,300 B2 4/2014 Hartl
8,919,061 B2 * 12/2014 Kortuem ..... E02D 31/02 52/302.3
8,955,278 B1 * 2/2015 Mills ..... E04B 5/48 52/302.3
9,057,193 B2 * 6/2015 Amend ..... B32B 37/04
9,194,119 B2 * 11/2015 Archbold ..... E04F 15/182
9,328,520 B1 * 5/2016 Kriser ..... F24D 3/14
9,890,959 B2 * 2/2018 Houle ..... E04F 15/107
10,100,517 B2 * 10/2018 Liang ..... E04F 15/182
2005/0193669 A1 * 9/2005 Jenkins ..... E04F 15/22 52/392
2006/0201092 A1 * 9/2006 Saathoff ..... E04F 13/047 52/385
2008/0086958 A1 * 4/2008 Schroer ..... E02D 31/02 52/169.14
2008/0290503 A1 * 11/2008 Karavakis ..... H01L 23/3737 257/713
2008/0290504 A1 * 11/2008 Karavakis ..... H01L 23/3737 257/713
2008/0295441 A1 * 12/2008 Carolan ..... E04C 2/322 52/633
2009/0026192 A1 * 1/2009 Fuhrman ..... H05B 3/06 219/523
2009/0230113 A1 * 9/2009 Batori ..... E04F 15/18 219/213
2011/0047907 A1 * 3/2011 Smolka ..... F24D 3/141 52/220.1
2011/0232217 A1 * 9/2011 Hartl ..... E04F 15/18 52/309.1
2012/0031026 A1 * 2/2012 Chen ..... E04F 15/041 52/220.2
2013/0095295 A1 * 4/2013 Masanek, Jr. ..... E01C 5/226 428/161
2014/0069039 A1 * 3/2014 Schluter ..... E04F 15/02194 52/390
2016/0130803 A1 * 5/2016 Comitale ..... B32B 3/28 428/166
2016/0192443 A1 * 6/2016 Schluter ..... H02G 9/02 174/97
2016/0273232 A1 * 9/2016 Bordin ..... F24D 3/141
2016/0377299 A1 * 12/2016 Larson ..... E04F 15/185 52/173.1
2020/0149291 A1 * 5/2020 Kaiser ..... E04F 15/182

FOREIGN PATENT DOCUMENTS

EP 2246467 B1 6/2012
EP 2372041 B1 8/2016

OTHER PUBLICATIONS

Written Opinion for International Application No. PCT/EP2018/059724, dated Jul. 17, 2018.
International Preliminary Report on Patentability for International Application No. PCT/EP2018/059724, dated Nov. 7, 2019.

* cited by examiner

UNCOUPLING STRIP

CROSS REFERENCE TO RELATED APPLICATIONS

This application is a national stage application under 35 U.S.C. 371 of PCT Application No. PCT/EP2018/059724 having an international filing date of 17 Apr. 2018, which designated the United States, which PCT application claimed the benefit of German Application No. 10 2017 004 000.1, filed 26 Apr. 2017, each of which are incorporated herein by reference in their entirety.

SUMMARY

The invention relates to an uncoupling strip or a decoupling sheet having a carrier plate and a plurality of nubs protruding from the carrier plate plane, wherein adjacent nubs are arranged transversely to the lengthwise direction of the carrier plate and in the lengthwise direction of the carrier plate.

In the present application, the term "decoupling" is understood to mean the reduction of shear stresses and/or stress peaks between two layers arranged in a fixed laminate. An effective decoupling thus prevents shear stresses and/or stress peaks which are present in one of the layers from being transmitted to the other layer of the joined structure and possibly causing damage there.

Decoupling sheets of the aforementioned kind are used for example in the construction industry when laying floors, especially for decoupling, sealing, and/or vapor pressure equalization. The decoupling sheets are installed, in particular glued, on an ground and form the bearing layer for flooring elements such as ceramic tiles. The installation of tiles is performed in particular on young screed in the thin-bed method. If no decoupling sheet is installed between the tiling and the young screed, upon shrinkage of the screed the tiles might not follow the movement of the screed especially on account of their low coefficient of expansion, so that shear stresses will be created, which in the end can lead to the detachment or even the breaking of the tiles. Decoupling sheets are also required when installing flooring on especially critical grounds, such as old wooden floors. A decoupling sheet of the aforementioned kind compensates for these shear stresses by deforming, so that no damage to the laminate structure is to be feared. Usually the decoupling sheets are made from filmlike plastic, i.e., from a flexible plastic layer, which is deformed under the action of external forces. The material is generally chosen to be low in emissions, especially as regards harmful substances.

For the attachment of the flooring elements to the decoupling sheet, a thin layer of a tile adhesive, also known as adhesive mortar or a bonding layer, is usually applied to the bearing plane of the decoupling sheet. It is understood that, in place of a tile adhesive, in the end an equally suitable adhesive or fastening layer and/or a corresponding material can also be provided. Tile adhesives are usually combed with a notched trowel or a toothed smoothing trowel, and a different tile adhesive will be used according to the area of application and/or the ground. For example, a reactive resin adhesive, a thin-bed cement mortar, a casein tile adhesive or a dispersion adhesive will be used as the tile adhesive.

After applying the tile adhesive to a decoupling sheet, the individual flooring elements and/or tiles will be installed on the tile adhesive. During this application, the tile adhesive penetrates into the recesses of the decoupling sheet and becomes hardened.

In decoupling sheets of this kind, the joined flooring elements are separated from the ground and mechanically decoupled. Thanks to the arrangement of the nubs transversely to the lengthwise direction and in the lengthwise direction of the carrier plate, channels arise which extend over the entire carrier plate. These channels interact with the nubs so that they intercept and compensate for mechanical loadings and particularly shear stresses. This loading of the flooring elements can be created by means of temperature and moisture influences and/or by the application of weight.

In the manufacture of decoupling sheets of this kind, a molding die having protrusions corresponding to the recesses and/or nubs is used. The stripping of the molding die from the decoupling sheet is usually problematic, however. Furthermore, the decoupling sheet may become damaged during the mold stripping, especially if the protrusions of the die have sharp edges which cut into the usually still-soft decoupling sheet material and/or rip it open. There have been attempts to solve the latter problem in practice by providing the corners of the mold protrusions with a radius.

Decoupling sheets of the aforementioned kind are known for example from EP 2 372 041 B1 and from EP 2 246 467 B1.

EP 2 372 041 B1 relates to a method for the production of a carrier plate as well as to a carrier plate for a sheet-clad floor, wall or ceiling assembly in order to achieve a decoupling between the ground and the surface covering to be placed on top of the filmlike sheet, the carrier plate comprising a filmlike sheet with a plurality of chambers formed by recesses from one plane of the filmlike sheet, whose end faces form a first sheet side and opposite to this a second sheet side. A bond-strengthening layer of a sheet-like material is placed at least on one sheet side, lining at least the recesses of the chambers. The bond-strengthening layer is supposed to aid in better decoupling and, furthermore, to aid in better attachment of the tile adhesive. The recesses serve to receive the tile adhesive, which is placed on the top side on the bond-strengthening layer of the decoupling sheet. In the known decoupling sheet, round, cylindrical and/or pot-shaped shapings are provided as the recesses.

Instead of a bond-strengthening layer and/or in addition to this, it is known from EP 2 246 467 B1 that an improved adherence of the tile adhesive should be possible by applying a multitude of fibers to the top side of the decoupling sheet, facing toward the tile adhesive. The nubs and/or recesses of this known decoupling sheet have a round, cylindrical and/or pot-like shape and are accordingly rounded. The fibers applied to the top surface of the decoupling sheet are permanently joined to this surface. The tile adhesive in this case is placed in the recesses of the carrier plate.

The decoupling sheets known from EP 2 372 041 B1 and EP 2 246 467 B1 have regularly arranged round, cylindrical shapings which are arranged in rows and columns. Thanks to the arrangement, channels are formed between the rows of nubs, extending over the entire decoupling sheet. These channels are open toward the ground and intersect with other channels. When the tile adhesive is applied, the channels are only partly covered with a thin coat of the tile adhesive, so that they form a weakening line which favors a deformation of the decoupling sheet along this weakening line. In an unfavorable arrangement, the lay of the joint of adjacent flooring elements would coincide with a weakening line and/or predetermined breaking point, so that hairline cracks and/or larger damaged areas will arise in the tile mortar layer and/or in the joint itself.

The drawback to the known decoupling sheets is that they have deficient decoupling properties between the flooring elements and the ground without the use of the additional bond-strengthening layer and/or without additional fibers. The production of such decoupling sheets is costly, since an additional process step of applying the bond-strengthening layer and/or additional fibers is provided in order to increase the adherence between the tile adhesive and the surface of the decoupling sheet facing toward the tile adhesive layer.

Now, the problem which the present invention proposes to solve is to provide a decoupling sheet which realizes improved decoupling properties between the flooring elements and the ground. In particular, an improved bond strength and/or grip of the tile adhesive on the decoupling sheet is to be achieved.

Furthermore, the problem which the present invention proposes to solve is to provide a simple and efficient method for the production of a decoupling sheet.

The aforementioned problem is substantially solved according to the invention in a decoupling sheet of the kind mentioned above in that immediately adjacent nubs transversely to the lengthwise direction and in the lengthwise direction of the carrier plate have a triaxial nub base, especially with at least three leg sides.

Alternatively and/or in addition, it is provided that at least one nub having a triaxial nub base with three long sides is provided and that the middle region of the triaxial nub base is defined by a circle which is tangentially touched by all the long sides.

By a triaxial formation of the nub base is meant a three-legged formation in a two-dimensional extension. The nub base and/or the nub accordingly has three legs. For the three-dimensional forming of the nub, it is provided that at least one side wall adjoins the nub base in order to form the nub interior space.

The triaxial nub shape is seen in a top view looking down on the decoupling sheet.

First of all, the present invention is distinguished in that a simple manufacturing of the decoupling sheet according to the invention is ensured. This manufacturing makes it possible in particular to accomplish high processing speed, preferably by a so-called inline process, wherein the decoupling sheet is manufactured continuously with a relatively high production speed. The increased production speed is made possible in particular by providing a quick and easy mold stripping of the decoupling sheet according to the invention. An increased processing speed results in particular in a decrease in the production time and thus a savings on production costs.

The nubs according to the invention and the nub arrangement according to the invention furthermore afford the possibility of an easy buttering of the decoupling sheet with tile adhesive. This buttering is especially simplified in that a triaxial form of the nubs and/or the nub bases is chosen, so that the tile adhesive can be well distributed within this nub form when applying the adhesive and placing it in the nubs and the air can easily escape from the recesses.

In addition, a good drying and a very good vapor pressure equalization is ensured, since the channels formed between adjacent nubs in the decoupling sheet according to the invention are joined together directly and/or indirectly over the entire nub sheet. Thanks to the triaxial nub shape of the nub bases, the channels are preferably rounded and/or wavy, so that a full-surface vapor pressure equalization without interruptions yields at the same time a good dehumidification as well as good ventilation. Thanks to the configuration of the decoupling sheet according to the invention, especially thanks to the very good vapor pressure equalization, the decoupling sheet can be placed in particular on a moist and possibly not fully hardened ground without the moisture still present in the ground becoming trapped and/or preventing or excessively delaying the desired drying of the ground. Consequently, the decoupling sheet can be installed soon after the production of the ground. In particular, this results in the advantage that the installation time of the overall floor cover can be drastically reduced, a rapid work sequence is ensured, and the production costs of the flooring are accordingly reduced.

Furthermore, the nub sheet according to the invention has improved decoupling properties, since an improved load distribution is achieved by a triaxial nub shape of the nub bases, preferably in combination with the orientation of the nubs in rows in the lengthwise direction and transversely to the lengthwise direction of the carrier plate, with a middle region which is defined by a circle. Furthermore, stress peaks are reduced or entirely avoided in some cases. The shear stresses are transmitted to the decoupling sheet and distributed in particular on the surface of the carrier plate facing toward the nubs. The distinctly improved load distribution is additionally achieved advantageously by the channel structure. The decoupling effect is advantageously such that, on the one hand, no cracks are created in the surface of the flooring facing away from the decoupling sheet and on the other hand possible cracks in the ground, which only arise in particular after the installation of the decoupling sheet, do not become evident in the tile adhesive layer and/or on the flooring elements.

In experiments that were conducted it was established that the decoupling properties were improved by up to 30% as compared to the decoupling sheet known in the prior art.

Besides a distinctly improved mold stripping and enhanced decoupling properties, the nub shape according to the invention furthermore ensures a greater strength of the tile bonding, since the tile adhesive is distributed very well in the recess produced by the nub and an interaction between the carrier plate and the nubs results in greater strength. Along with this, the bond strength of the overall decoupling sheet is increased. No additional bond-strengthening layer or supplemental fibers are required, so that the production costs can be reduced.

The bond strength serves as a parameter of the adhesion of layers to grounds, especially concrete surfaces. It is determined by means of special testing, also known as a bond strength test and/or pull-off test. DIN EN 1348 contains instructions for determining the bond strength under defined conditions.

Thanks to the increased strength of the tile bonding and the improved decoupling properties, a lower overall layer assembly height of the decoupling sheets according to the invention can be selected as compared to the decoupling sheet known in the prior art. This lower overall layer assembly means, among other things, that less tile adhesive is needed during the installation for the bonding of the flooring elements to the decoupling sheet, so that there are lower production costs for the flooring being laid.

The decoupling sheet according to the invention furthermore has a high torsional strength, preferably while preserving a good winding capability. The high torsional strength and/or torsional stiffness means that the decoupling sheet cannot bend and/or twist, especially by 90°. Yet the preserved winding capability means that the decoupling sheet can be rolled up, preferably for transport.

Furthermore, it has been established in experiments that were conducted that, besides its excellent decoupling properties, the decoupling sheet according to the invention also has very good footfall muffling. This effect as well is a result of the special nub shape and arrangement.

In one advantageous embodiment of the idea of the invention, the nub and/or the nub base has a concave shape on at least one long side. This concave shape of the long side means that an improved mold stripping can occur, since in particular no corners are present between the long sides. An improved mold stripping means an easier and/or improved manufacturing process.

Furthermore, in one preferred embodiment of the decoupling sheet according to the invention at least one shaping is provided in the region of the long side and/or leg side of the nub and/or the nub base in order to form an undercut on the interior side of the nub. It is understood, that in the end two leg sides can also form one long side, and/or the leg side itself represents the long side. The tile adhesive penetrates into the undercut during the buttering, so that a better grip is produced. This, in turn, results in a securing of the tile set and/or flooring elements to be applied on the decoupling mat.

In one especially advantageous embodiment of the idea of the invention, the shaping to form the undercut on the interior side of the nub is in the form of a sickle and/or an arc segment and/or a crescent. This arc segment formation results in particular in an improved mold stripping during the manufacturing of the decoupling sheet. By contrast with angular undercuts, in the case of a rounded and/or sickle shape of the undercut there is advantageously ensured an easier separation between the molding die and the decoupling sheet. Thus, in particular, the decoupling sheet will not be damaged when stripped from the mold. Moreover, the rounded undercuts preferably serve for reducing the stress peaks of the shear stress of the flooring elements and/or distributing them evenly on the decoupling sheet.

In another embodiment according to the invention, the shaping is formed by a protrusion protruding from the nub interior space. In an especially advantageous embodiment, the protrusion is provided in the area of the nub base, wherein the protrusion in particular merges directly into the nub base. This immediate merging of the protrusion into the nub base results in an improved mold stripping, so that the molding die can be removed from the decoupling sheet with no problem, especially even when the state of the decoupling sheet material is not yet completely hardened, with no fear of damaging the decoupling sheet during the mold stripping.

This advantage also results in particular when the shaping extends for at least 40%, preferably for between 50% and 100% and especially for between 60% and 90% of the length of the long side and/or the leg side. These dimensions mean that the end region of the nub and/or the triaxial nub base resulting from two converging long sides is undercut-free and/or has no shaping in this region. In this embodiment, the molding die may have sharp-edged corners in the end region without causing damage to the decoupling sheet during the mold stripping.

In another embodiment of the idea of the invention, it is provided that the end region of the nub and/or the triaxial nub base results from two converging long sides is rounded and without corners. In one preferred configuration of the embodiment of the decoupling sheet, the radius of a concave long side is multiple times longer than the radius of an end region, with the radius of a concave long side preferably twice as large as the radius of an end region. Thanks to the concave long sides and the rounded and/or convex end regions of the long sides, a curved nub shape is produced, which significantly reduces and/or in some cases totally prevents stress peaks from arising. These end regions, which in particular are free of undercuts, work against air inclusions and thus make the buttering easier.

Moreover, it has been established in experiments that were conducted that it is especially advantageous for the nub and/or the triaxial nub base to have mirror symmetry with respect to a center axis running substantially parallel to the lengthwise direction. This mirror-symmetrical nub axis is advantageous not only in terms of manufacturing technology, but also decisively advantageous in regard to the product properties of the decoupling sheet, as shall be discussed in the following.

In another advantageous embodiment of the idea of the invention, it is provided that the angle of the leg emerging from the middle region between the respectively adjacent, spaced-apart leg axes is at least 90°.

In order to ensure an optimized arrangement of the nubs on the decoupling sheet, it is provided in another embodiment according to the invention that the leg length of one leg, especially that of the leg running parallel to the lengthwise direction of the decoupling sheet, is less than the other two leg lengths. It is especially advantageous when the angle situated between the leg axis of the shorter leg and the leg axis of the adjacent leg is greater than 120° and especially less than 130°. Thanks to a preferred mirror-symmetry arrangement, two larger angles are provided for the nub and/or for the triaxial nub base and the angle which is enclosed between the leg axes of the longer legs is accordingly less than 120°. As compared to the usual rectangular and/or rotationally symmetrical geometries customary in the prior art, this geometry affords the benefit in particular of improved decoupling properties of the entire decoupling sheet when using the nub with the aforementioned properties.

It should be pointed out in this context that especially improved decoupling properties result when there is provided on the decoupling sheet a plurality of nubs according to the invention. In one preferred exemplary embodiment, it is provided that the nubs running transversely to the lengthwise direction of the carrier plate are arranged such that on the carrier plate no continuous straight line running transversely to the lengthwise direction of the carrier plate is formed, and/or nubs running in the lengthwise direction of the carrier plate are arranged such that on the carrier plate no continuous straight line running in the lengthwise direction of the carrier plate is formed, and/or nubs running longitudinally and transversely to the lengthwise direction of the carrier plate are arranged such that on the carrier plate no continuous straight line running at a slant to the lengthwise direction of the carrier plate is formed. The term "continuous" here means a connection from one edge of the decoupling sheet to the opposite edge of the decoupling sheet on the other lengthwise or transverse side of the decoupling sheet. According to the invention, this is accomplished in particular in that a nub having a triaxial nub base with the aforementioned properties is used and thus makes possible this configuration thanks to the arrangement and thus the interaction of the nubs.

Thanks to the aforementioned configuration, weakening lines and/or predetermined breaking edges of the nub sheet exceeding the overall nub diameter, especially exceeding it by a multiple, are avoided. The arrangement of the nubs in the aforementioned manner produces channel segments between the nubs which have a trend, especially a meandering trend, in right and left curves, so that the channel segments extend over the carrier plate in a preferably wavy manner. By avoiding a straight trend of the individual channels, one can advantageously prevent the formation of weakening lines running straight across the decoupling sheet. In the end, it is not relevant how the decoupling sheet is installed in a room, so that in any given direction a channel segment running in this direction will come up against a nub if extended in a straight line, so that the weakening line segment formed by the respective channel segment will be interrupted, thus preventing in particular the formation of longer weakening lines. Accordingly, regardless of the orientation of the decoupling sheet during its installation, it can be ensured that the joints formed in the installed floor covering will always extend across nubs for a segment, so that no joints will be congruent with a longer channel segment of the decoupling sheet.

The carrier plate according to the invention has only such channels as extend from one side edge to another side edge of the carrier plate and run in right and left curves, relative to the transverse direction of the decoupling sheet and/or the carrier plate. Each space between two adjacent nubs represents a channel segment and is part of a channel, so that weakening lines and/or predetermined breaking edges between spaced-apart nubs running in a straight line across the carrier plate are precluded.

In another preferred embodiment, the nubs are arranged in rows running in both the lengthwise direction and transverse direction, wherein the center points of the nubs running in the lengthwise direction are arranged on a line running at least substantially parallel to the lengthwise direction of the decoupling sheet and wherein the center points of the nubs running transversely to the lengthwise direction are arranged on a line running at least substantially perpendicular to the lengthwise direction. This arrangement of the nubs results in manufacturing technology benefits, since this preferably symmetrical arrangement of the nubs can be produced by an embossing mechanism, preferably a nub roller, by means of molding dies in a filmlike material which is fed to the embossing mechanism as the base material of the decoupling mat. The molding dies are arranged on the nub roller, so that the embossing of the nubs can occur in a continuous manufacturing process.

Another possible and supplemental aspect of the present invention is that the shorter leg of the nubs and/or the nub base arranged in a row of successively arranged nubs running substantially parallel to the lengthwise direction is oriented in the lengthwise direction. In an immediately adjacent row of nubs running at least substantially parallel to the lengthwise direction, the shorter legs of the nubs are oriented opposite to the lengthwise direction. In particular, it is possible in this case to avoid the aforementioned weakening lines across the decoupling sheet by not having the resulting channel segments in a straight line between the adjacent nubs. The shorter legs according to the invention ensure in this case that the nubs are arranged in lengthwise and transverse rows to the carrier plate, yet without having and/or forming a weakening line.

Preferably, in another embodiment of the idea of the invention, it is provided that the arrangement of the nubs on the carrier plate is embodied such that the shortest distance between two adjacent nubs is always roughly equally large, especially with a deviation of +/−20%, preferably +/−10%. This creates in particular an identical or approximately identical channel width, wherein thanks to the nub shape the channels extend in meandering fashion across the carrier plate. Advantageously, one leg of the nubs is to be configured shorter in order to form identical channel widths and/or to ensure an at least substantially shortest constant segment between two adjacent nubs.

In another preferred embodiment of the idea of the invention, it is provided that the nubs are arranged and/or configured such that roughly the same flow cross section results in the channels, especially with a deviation of +/−20%, preferably +/−10%.

Basically, it is understood that on the outside of the nub bases a flat connection means for connecting between the decoupling sheet and the ground can be provided. Preferably, this connection means is fastened to the nub bases, wherein in particular the connection means is embodied as a nonwoven and/or a textile and/or a scrim and/or a lattice and/or paper, especially formed over the entire surface and/or in a lattice shape. The connection means according to the invention ensures that the nub base is fixedly joined via the connection means to the ground, so that in particular its bond strength is increased. Preferably, the connection means is directly placed in the outside of the nub bases during the manufacturing process of the decoupling sheet. Thanks to the fixed connection of the decoupling sheet to the ground by means of the connection means, a shifting between the flooring layer and the decoupling sheet is preferably avoided.

The arrangement of the connection means on the nub bases is preferably designed so that the channels and/or channel segments are produced between the outsides of the nubs and the connection means, by which a dehumidification and/or a ventilation is possible. The connection means is usually facing toward the ground on which the decoupling sheet is placed. The openings into the individual nubs are oriented toward the installation side, so that the tile adhesive can be placed into the nubs and/or the nub interior spaces.

In another preferred embodiment of the present invention, the height of the nubs is between 1 and 5 mm, preferably between 2 and 4 mm, further preferably between 2.5 and 3.5 mm. This relatively low nub height enables a low overall layered structure and entails a reduced amount of tile adhesive needed for the bonding between the decoupling sheet and the flooring elements. However, due to the special nub shape and formation, a firm bond is achieved between the tile adhesive and the decoupling sheet while at the same time accomplishing an excellent decoupling effect.

In another preferred embodiment, the clear gap between adjacent nubs has a width greater than 2 mm, in particular, between 3 mm and 9 mm, preferably between 4 and 8 mm, further preferably between 5 and 6 mm. This clear gap also determines the width of the channel segment and thus defines the free space between adjacent nubs. The channel segment in this case, due to the width which is present, accomplishes not only a good dehumidification and ventilation of the subfloor, but also a uniform heat distribution, especially in system designs with underfloor heating.

Furthermore, in another preferred embodiment it is provided that the ratio of the area of the nub bases of all the nubs to the carrier plate is preferably between 40% and 70%, further preferably between 45% and 55% and especially at least substantially 50%. It has been established in experiments that were conducted that, by observing the aforementioned ratio, especially good decoupling values are achieved at the same time as an especially firm attachment of the tile adhesive to the decoupling sheet. Along with the nub height, the aforementioned ratio also critically defines the required amount of tile adhesive used for the joining of the decoupling sheet and the flooring element. In particular, a load distribution of the occurring shear stress on the carrier plate is made possible by the channels, wherein preferably a compensation of the occurring stresses is accomplished. In the end, in experiments it was found that the ratio of 40% to 60%, preferably 45% to 55%, is especially advantageous and has good decoupling properties as well as a good bond strength.

In one especially preferred embodiment of the invention it is provided that on the side of the nub base of at least one nub facing toward the nub interior space at least one protrusion and/or recess is provided and/or that at least one protrusion and/or recess is comprised on the side of the carrier plate facing toward the nub interior space. As a result, it is provided that projecting protrusions and/or recesses are present on the nub base and/or the carrier plate which are provided for the gripping/bonding to the tile adhesive to be applied to the decoupling sheet on the tile side. Here, the protrusions and/or recesses are in the end material overhangs, but do not involve breaches in the nub base and/or the carrier plate making possible an exchange of air and/or moisture from the bottom side to the tile side.

The aforementioned embodiment of the invention enlarges the exposed surface of the nub bases and the surface of the carrier plate facing away from the nub bases, i.e., the surface of the webs provided on the carrier plate between the individual nub openings protruding into the nub interior spaces. The protrusions and/or recesses and the accordingly enlarged surface provide an improved grip of the tile adhesive, wherein no additional bond-strengthening layer is required on the surface of the carrier plate to achieve this effect, so that the production in particular can be organized more easily. The protrusions and/or recesses according to the invention also improve the mold stripping of the overall decoupling sheet. The protrusions and/or recesses mean in particular that the decoupling sheet has increased bending stiffness and/or torsional stiffness.

In an especially advantageous embodiment, it is provided that the protrusion and/or recess on the nub base is in the shape of a spiral and/or an arc segment. It has been established that the spiral and/or rounded form of the protrusion and/or recess in particular results in an improved grip of the tile adhesive. In the end, it has been determined during experiments that it is especially advantageous when the spiral protrusion and/or recess is provided in the middle region of the nub base.

Moreover, it is understood that a plurality of protrusions and/or recesses can be provided on the nub base, so that the bond strength between the decoupling sheet and the flooring elements is increased.

Preferably, the structuring and/or the recesses and/or the protrusions of the nub base and/or of the carrier plate have a height and/or a depth greater than 1 μm, preferably greater than 100 μm, further preferably between 100 and 1000 μm and especially at least substantially between 300 and 500 μm. If a protrusion directly adjoins a recess, wherein the protrusion protrudes from the plane of the nub base and/or the carrier plate and the recess protrude into the nub base and/or the carrier plate, the spacing between the lowest point of the recess and the highest point of the protrusion is preferably greater than 50 μm, further preferably greater than 100 μm, further preferably between 100 and 300 μm and especially at least substantially between 300 and 800 μm.

In another advantageous embodiment of the idea of the invention, it is provided that the protrusions and/or the recesses on the nub base and/or the carrier plate form a structured surface of the nub base and/or the carrier plate.

Advantageously, the protrusions and/or recesses are arranged in an irregular and/or unordered manner, preferably on both the nub base and the carrier plate.

Advantageously in this context, the most diverse forms and/or structures of the recesses and/or protrusions are provided, in particular wherein the shapes and/or structures of the protrusions and/or recesses result from the manner of producing the protrusions and/or recesses.

In the end, it is preferably provided according to the invention that a structured surface is formed for better gripping of the tile adhesive, wherein a structuring of the surface results by virtue of protrusions and/or recesses. As is explained below, the protrusions and/or recesses may have a fixed geometrical shape, in particular being embossed during the manufacturing of the decoupling sheet, and/or they comprise the most diverse structures and/or shapes, wherein it is essential to the invention that the protrusions and/or recesses have a maximum height and/or depth of more than 1 μm.

In another preferred variant embodiment, a shaping is provided in order to form an undercut on the protrusions and/or recesses. This shaping forms the undercut, especially wherein the undercut serves for better gripping of the tile adhesive to the surface of the carrier plate and/or the nub base, wherein the tile adhesive preferably engages with and gripping the region of the undercut.

Advantageously, it is provided for a structuring of the nub base and/or the carrier plate that at least 30% of the free surface of the nub base and/or the carrier plate is structured and/or comprises recesses and/or protrusions. Preferably, over 50% of the carrier plate and/or over 50% of the overall surface of all nub bases is structured and/or comprises recesses and/or protrusions. This structured surface ensures a better grip of the tile adhesive and an increased bond strength for the entire decoupling sheet.

Accordingly, in a further preferred embodiment in connection with the three-legged nub, it is provided that the leg bottom of a leg of the nub has a plurality of protrusions and/or recesses. In another preferred embodiment of the invention, the protrusions and/or recesses are arranged concentrically to the middle region and/or to the center point of the nub on the leg bottom.

Furthermore, it has been established that it is especially advantageous for the protrusions and/or recesses of the nub base in another embodiment to be formed web-like and/or rectangular-shaped and/or elliptical-shaped. In this regard, it is especially preferable for the web-like and/or rectangular-shaped and/or elliptical-shaped protrusions and/or recesses on the nub base to be oriented transversely and/or longitudinally to the lengthwise direction of the carrier plate. This arrangement of the protrusions and/or recesses on the nub base enables, along with good stripping of the nub sheet from the mold, in particular an easy buttering of the decoupling sheet with the tile adhesive.

It is understood that not only can protrusions and/or recesses be placed on the nub base, but also in a further preferred embodiment protrusions and/or recesses may also be provided alternatively or additionally to the protrusions and/or recesses on the nub base likewise on the carrier plate and/or the carrier plate webs between the nub openings protruding into the nub interior spaces, both in the lengthwise direction of the carrier plate and in the transverse direction of the carrier plate. This arrangement of the protrusions and/or recesses on the carrier plate, especially in combination with a referred embodiment of the protrusions in web-like and/or rectangular-shaped and/or elliptical-shaped form, produces an especially good grip of the tile adhesive.

Furthermore, in another preferred embodiment of the invention it is provided that the protrusions and/or recesses of the carrier plate are elongated and oriented by their longitudinal extension solely transversely and/or longitudinally to the lengthwise direction of the carrier plate. This orientation in combination with the elongated shape brings about in particular a better grip of the tile adhesive to the carrier plate.

In an especially preferred embodiment of the invention, a special arrangement of the protrusions and/or recesses is provided in which they run in rows transversely and/or longitudinally to the lengthwise direction of the carrier plate and are arranged in alternating orientation. Precisely such a formation and arrangement produces a good grip of the tile adhesive to the carrier plate.

Furthermore, a method is provided for production of the decoupling sheet having a carrier plate and a plurality of nubs protruding from the carrier plate plane wherein adjacent nubs are arranged transversely to the lengthwise direction of the carrier plate and in the lengthwise direction of the carrier plate. In the method according to the invention, it is provided that the nub bases of immediately adjacent nubs have a triaxial formation transversely to the lengthwise direction and in the lengthwise direction of the carrier plate.

Preferably, the side of the nub base of at least one nub facing toward the nub interior space comprises at least one protrusion and/or recess and/or the side of the carrier plate facing toward the nub interior space comprises one protrusion and/or recess.

In one preferred design of the method according to the invention, it is provided that the protrusion and/or the recess is made by laser methods, plasma methods, mechanical methods, and/or by embossing during and/or after the production of the decoupling sheet.

In the end, it is understood that the protrusions and/or recesses can be placed in the decoupling sheet and/or the carrier plate and/or the nub base after the production of the decoupling sheet, in particular in a separate process step.

In terms of manufacturing technology, it is convenient to perform the embossing of the protrusions and/or recesses in the decoupling sheet directly during the production of the decoupling sheet, so that the protrusions and/or recesses are positioned directly by means of recesses and/or elevations on the molding dies and/or the embossing mechanism and/or the nub roller.

In another embodiment, it is provided that the embossing is performed after the production of the decoupling sheet by an additional and/or further embossing roller, one which is heated in particular. This additional embossing roller is adjacent in the production direction to the actual nub roller by which the decoupling sheet per se is created.

The surface modification may alternatively be done by mechanical methods, such as blasting, for example when using sand and/or nutshells. A roughening of the surface during mechanical methods can be done by using brushes and/or abrasive paper, for example. The processing (roughening) of the surface with a needle roller is also possible. The aforementioned methods result in a structured surface and/or a profiling of the surface, so that in particular an increased roughness is produced.

In the plasma method, high-energy electrons and ions are generated in particular directly from the surrounding atmosphere by means of strong electric fields and used to generate a plasma. In this way, the surface structure of the decoupling sheet is attacked accordingly. The laser method preferably involves treatment of the surface of the decoupling sheet with a pulsed laser beam source, which can be directed preferably with high beam intensity onto the surface of the decoupling sheet.

When installing the decoupling mat on an ground, a bond-strengthening layer can be placed between the decoupling sheet and the flooring elements, preferably by wiping and/or spraying and/or brushing it onto the decoupling sheet. Basically, it is also conceivable to apply a bond-strengthening layer to the decoupling sheet already during the manufacturing of the decoupling sheet by buttering and/or spraying and/or brushing.

Hence, the invention relates to a decoupling sheet having a carrier plate and a plurality of nubs protruding from the carrier plate, wherein adjacent nubs are arranged transversely to the lengthwise direction of the carrier plate and in the lengthwise direction of the carrier plate, wherein immediately adjacent nubs transversely to the lengthwise direction and in the lengthwise direction of the carrier plate have a nub base of triaxial shape. Alternatively or additionally to this, it may be provided that at least one nub is present having a triaxial nub base with three long sides and the middle region of the nub and/or the triaxial nub base is defined by a circle which all the long sides contact tangentially. Furthermore, it has been established that in order to improve the decoupling properties and increase the bond strength, at least one protrusion and/or recess is provided on the nub bases and/or the surface of the carrier plate that is facing away from the nub bases. In the end, the invention also relates to a method for production of a decoupling sheet, especially one having the protrusions and/or recesses according to the invention.

Moreover, it is understood that the aforementioned intervals and range limits include any intermediate intervals and individual values and are to be seen as being disclosed as essential to the invention, even if these intermediate intervals and individual values are not specifically indicated.

BRIEF DESCRIPTION OF THE DRAWINGS

Further features, benefits and application possibilities of the present invention will emerge from the following description of exemplary embodiments with the aid of the drawing, and from the drawing itself. All of the described and/or depicted features in themselves or in any given combination form the subject matter of the present invention, regardless of their statement in the claims or their reference back to the claims.

DETAILED DESCRIPTION

Figure 1:
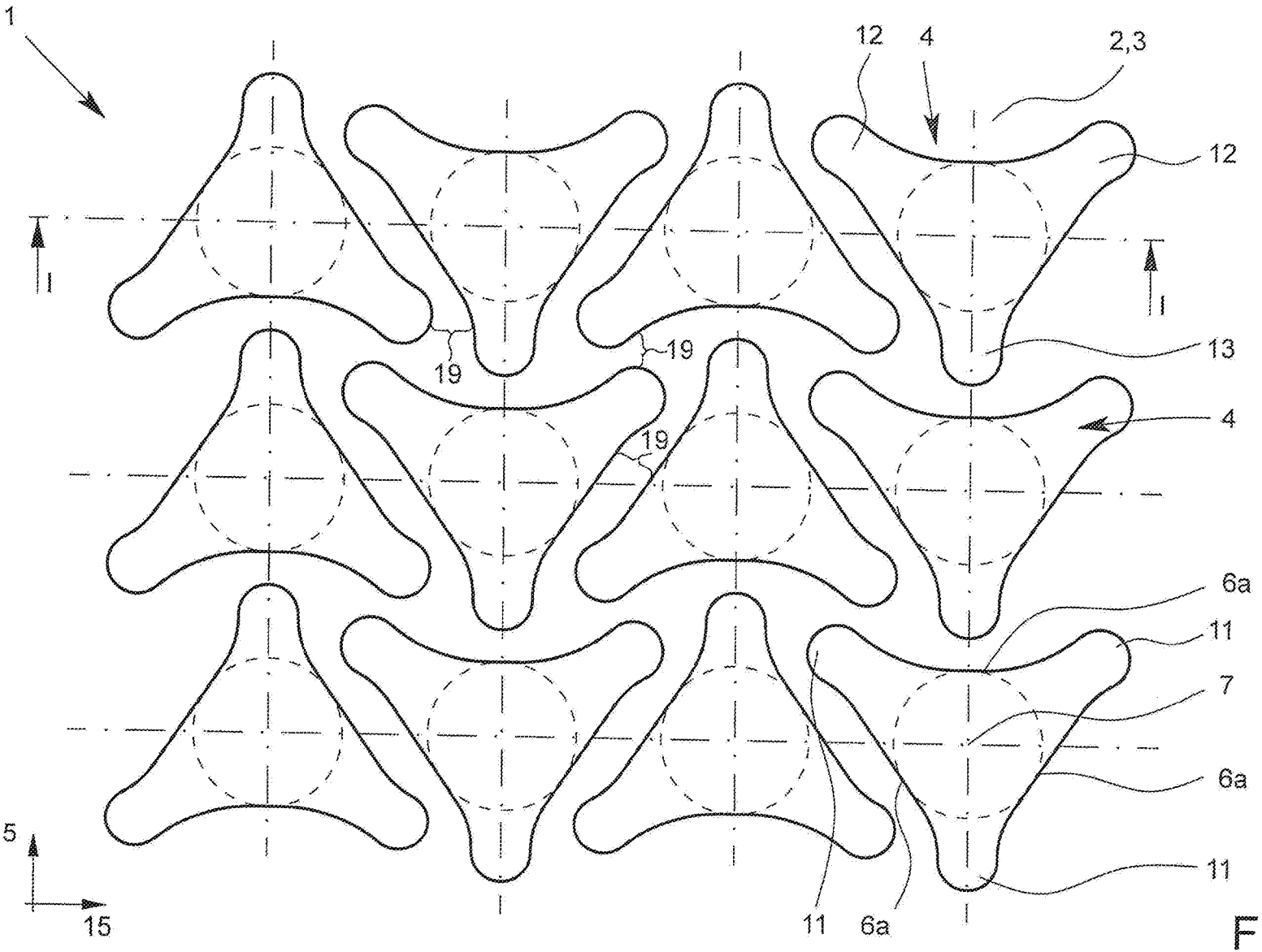
FIG. 1 shows a schematic top view of a portion of a decoupling sheet in accordance with the invention.

FIG. 1 shows a portion of a decoupling sheet 1 in accordance with the invention with a carrier plate 2 and a plurality of nubs 4 protruding from the carrier plate plane 3. Adjacent nubs 4 are arranged transversely to the lengthwise direction 5 (in the transverse direction 15) of the carrier plate 2 and in the lengthwise direction 5 of the carrier plate 2. Furthermore, FIG. 1 illustrates that immediately adjacent nubs 4 transversely to the lengthwise direction 5 (in the transverse direction 15) and in the lengthwise direction 5 of the carrier plate 2 have a triaxial nub base 10.

The triaxial formation of the nub 4 and/or the nub base 10 means that three legs 12, 13 are provided. The triaxial formation of the nub base 10 is evident in the top view looking down on the decoupling sheet 1 and hence in a top view looking down on the nub 4.

The immediate proximity of the nubs 4 in the lengthwise direction 5 and in the transverse direction 15 occurs in the case of a group of at least three nubs 4. This means that at least three immediately adjacent nubs 4 comprise a triaxially shaped nub base 10 in the lengthwise direction 5 and in the transverse direction 15. In the arrangement of the nubs 4 on the carrier plate 2 it is provided that the nubs 4 and the nub bases 10 neither intersect nor overlap. In the end, it is understood that in an embodiment of the decoupling sheet 1 according to the invention (not shown), it may be provided that different nub shapes and/or forms of the nub base 10—both triaxial and any given shapes—may be used on the decoupling sheet 1. In this variant embodiment (not shown), however, a group of at least three immediately adjacent nubs 4 with a triaxial nub base 10 is formed.

Figure 3:
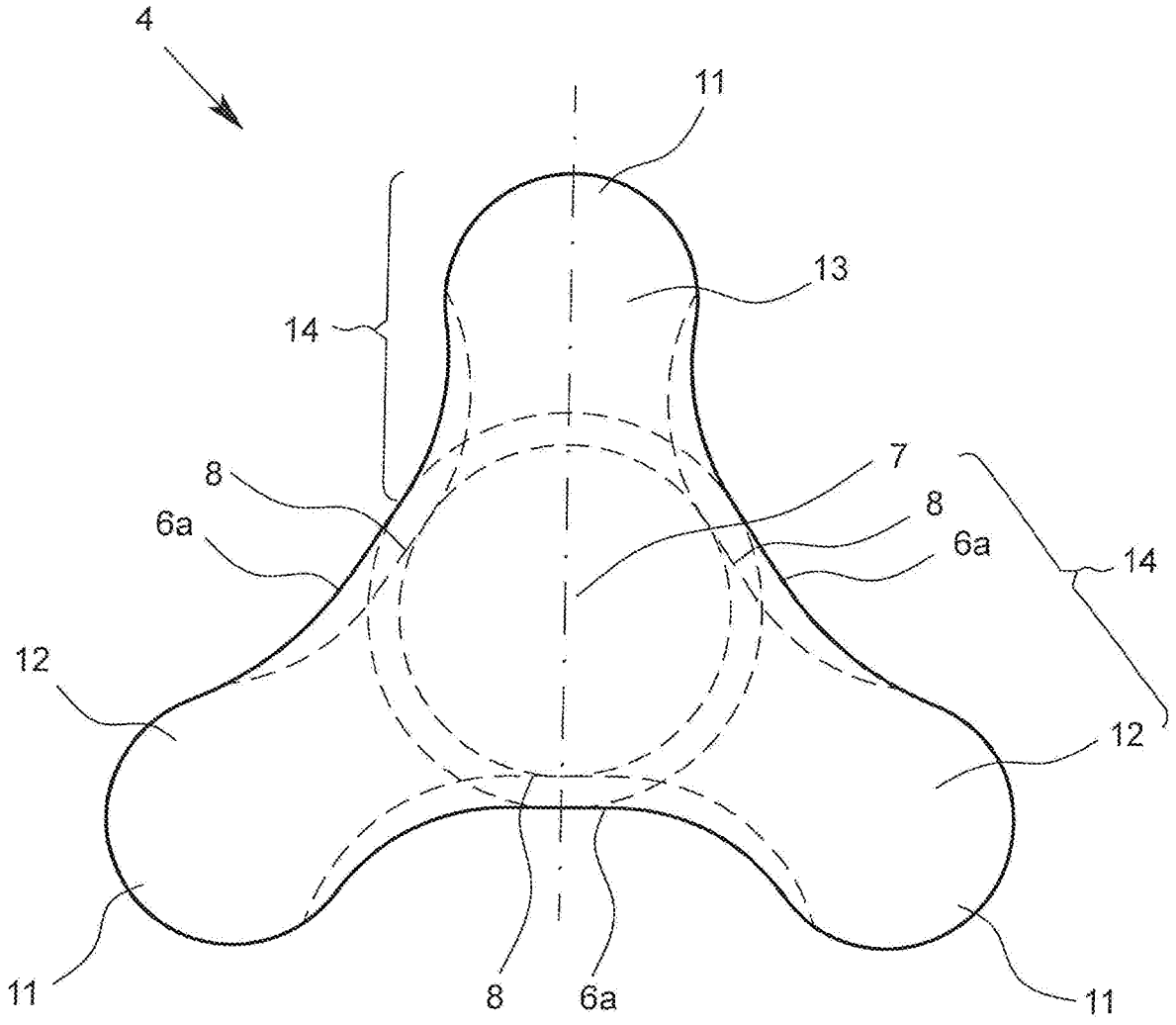
FIG. 3 shows a schematic top view of a nub in accordance with the invention.
Figure 4:
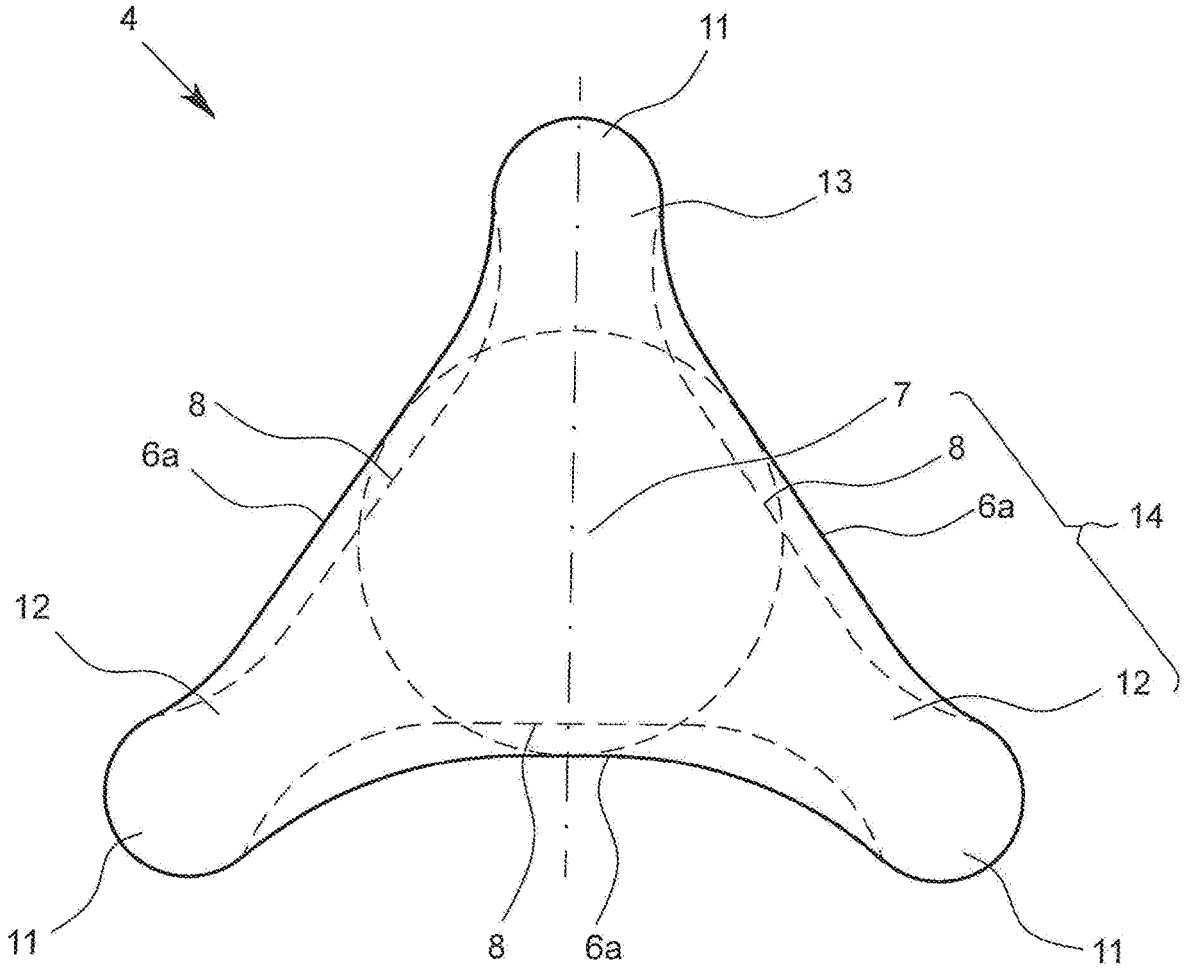
FIG. 4 shows a schematic top view of another embodiment of a nub in accordance with the invention.

Alternatively and/or additionally to the triaxial formation of immediately adjacent nubs 4 in the lengthwise direction 5 and in the transverse direction 15, it is provided that on the decoupling sheet 1 at least one nub 4 having a triaxial nub base 10 with three long sides 6*a* is present. FIGS. 3 and 4 show that the middle region 7 of the nub 4 and/or the nub base 10 is defined by a circle which all the long sides 6 contact tangentially.

FIGS. 3 and 4 show various embodiments of the triaxial nub shape with different triaxial nub bases 10 having three long sides 6*a*.

Moreover, FIG. 1 shows the arrangement of the nubs 4 per FIG. 4 on a decoupling sheet 1, wherein all the nubs 4 have a triaxial nub base 10.

In a variant embodiment (not shown), only one nub shape having a triaxial nub base 10 with three long sides 6*a* per FIG. 3 or 4 is provided, which is placed in a carrier plate 2, wherein the other nubs 4 have familiar nub structures, for example cylindrical and/or pot-shaped.

Moreover, FIGS. 3 and 4 show that the long side 6 of the nub 4 and/or the nub base 10 is concave. In a variant embodiment (not shown), only one long side 6*a* of the nub 4 or two long sides 6*a* of the nub 4 are concave.

A nub interior space 20 is formed by the nub base 10 and at least one side wall adjoining the nub base 10, wherein the at least one side wall produces the three-dimensional shape of the nub 4.

Figure 2:
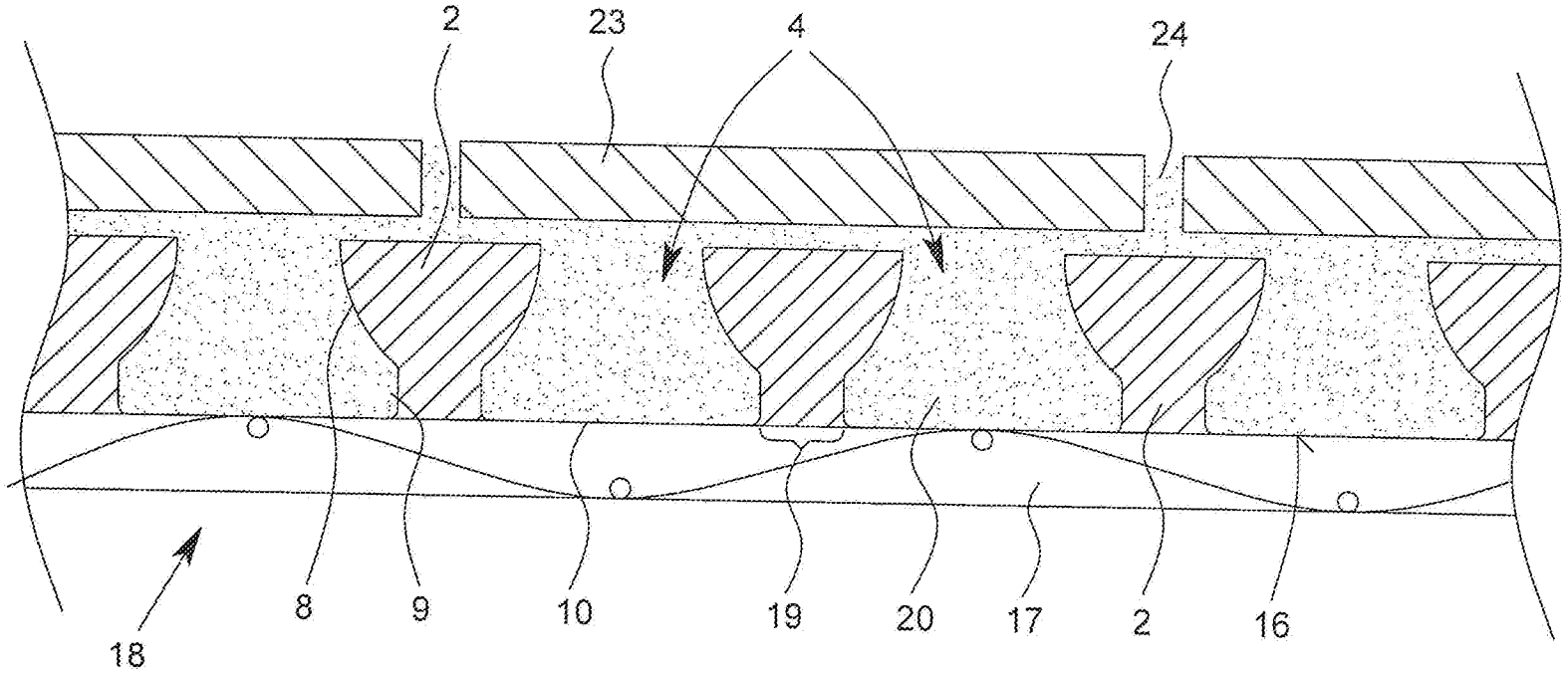
FIG. 2 shows a schematic cross-sectional view along line I-I of FIG. 1.

FIG. 2 shows that in the exemplary embodiment illustrated, an undercut 8 is present at the nub interior side. This nub interior undercut 8 is formed by the shaping 8, wherein the shaping 8 in the exemplary embodiment shown is sickle-shaped and/or shaped as an arc segment and/or shaped as a crescent. The shaping 8 is furthermore formed by a protrusion 9 sticking out from the nub interior space 20. The shaping 8 in FIGS. 3 and 4 is provided in the area of the long side 6*a* of the nub 4. It is clear with the aid of FIG. 2 that the protrusion 9 in the exemplary embodiment shown is arranged in the area of the nub base 10, wherein it merges into the nub base 10. Moreover, FIGS. 3 and 4 show that the shaping 8 extends for around 90% of the long side 6*a*. In an embodiment (not shown), it is provided that the shaping 8 extends for at least 40%, preferably in further embodiments between 50 and 100% and especially between 60 and 90%, of the long side 6*a*.

Further, FIGS. 3 and 4 show that the end region 11 resulting from two converging long sides 6*a* is undercut-free and thus has neither an undercut 8 nor a protrusion 9 to form the undercut 8. In addition, in the exemplary embodiment shown, the resulting end region 11 is rounded and formed without corners, wherein the rounding is described by means of a circular arc segment. The radius characterizing the concavity of the long side 6*a* is multiple times larger than the radius determining the circular arc segment of the end region 11.

In addition, FIGS. 3 and 4 show that the nub 4 and/or the triaxial nub base 10 has mirror symmetry with respect to a center axis running at least substantially parallel to the lengthwise direction 5. This mirror symmetry is also clearly shown by FIG. 1. In the triaxial nub shape of the nub base 10 per FIGS. 3 and 4, three legs 12, 13 are provided spaced apart from each other and emerging from the middle region 7.

FIGS. 3 and 4 make it clear that a leg length 14 of one leg 13 running parallel to the center axis is shorter than the other two leg lengths 14 of the leg 12. Furthermore, in the exemplary embodiment shown, different angles of the leg axes are also provided. Basically, in all nub shapes shown for the nub 4, angles between two adjacent leg axes greater than 90° are provided. In the configuration of the nub 4 according to the invention in FIGS. 3 and 4, it is provided that the angle of the leg axis of the shorter leg 13 with respect to the leg axis of the adjacent leg 12 is greater than 120°, being around 123° in the exemplary embodiment shown. Consequently, the angle between the leg axes of the legs 12 is less than 120°, around 114°.

The configuration of the nub 4 with a triaxial nub base 10 makes possible the nub arrangement of FIG. 1. In this exemplary embodiment, it is provided that the nubs 4 running transversely to the lengthwise direction 5 of the carrier plate 2 are arranged such that no continuous straight line running transversely to the lengthwise direction 5 of the carrier plate 2 and thus in the transverse direction 15 of the carrier plate 2 is formed on the carrier plate 2 and/or carrier plate plane 3. Furthermore, it is also provided that the nubs 4 running in the lengthwise direction 5 of the carrier plate 2 are arranged such that no continuous straight line running in the lengthwise direction 5 of the carrier plate 2 is formed on the carrier plate 2. However, not only are straight lines avoided in the lengthwise direction 5 and in the transverse direction 15, but also the nubs 4 running longitudinally and transversely to the lengthwise direction 5 of the carrier plate 2 are arranged such that no continuous straight line running at a slant to the lengthwise direction 5 of the carrier plate 2 is formed on the carrier plate 2. Consequently, no straight line results on the decoupling sheet 1, since respective individual line segments are interrupted by the nubs 4. The channel segment with the clear gap 19 occurring between two nubs 4 is arranged such that it extends in a meandering manner per FIG. 1 across the decoupling sheet 1. The lines possibly produced in the channel segment cannot continue in a straight line across the carrier plate 2. In each case, a leg 12, 13 of an adjacent nub 4 protrudes into the channel segment between two nubs 4.

Figure 5:
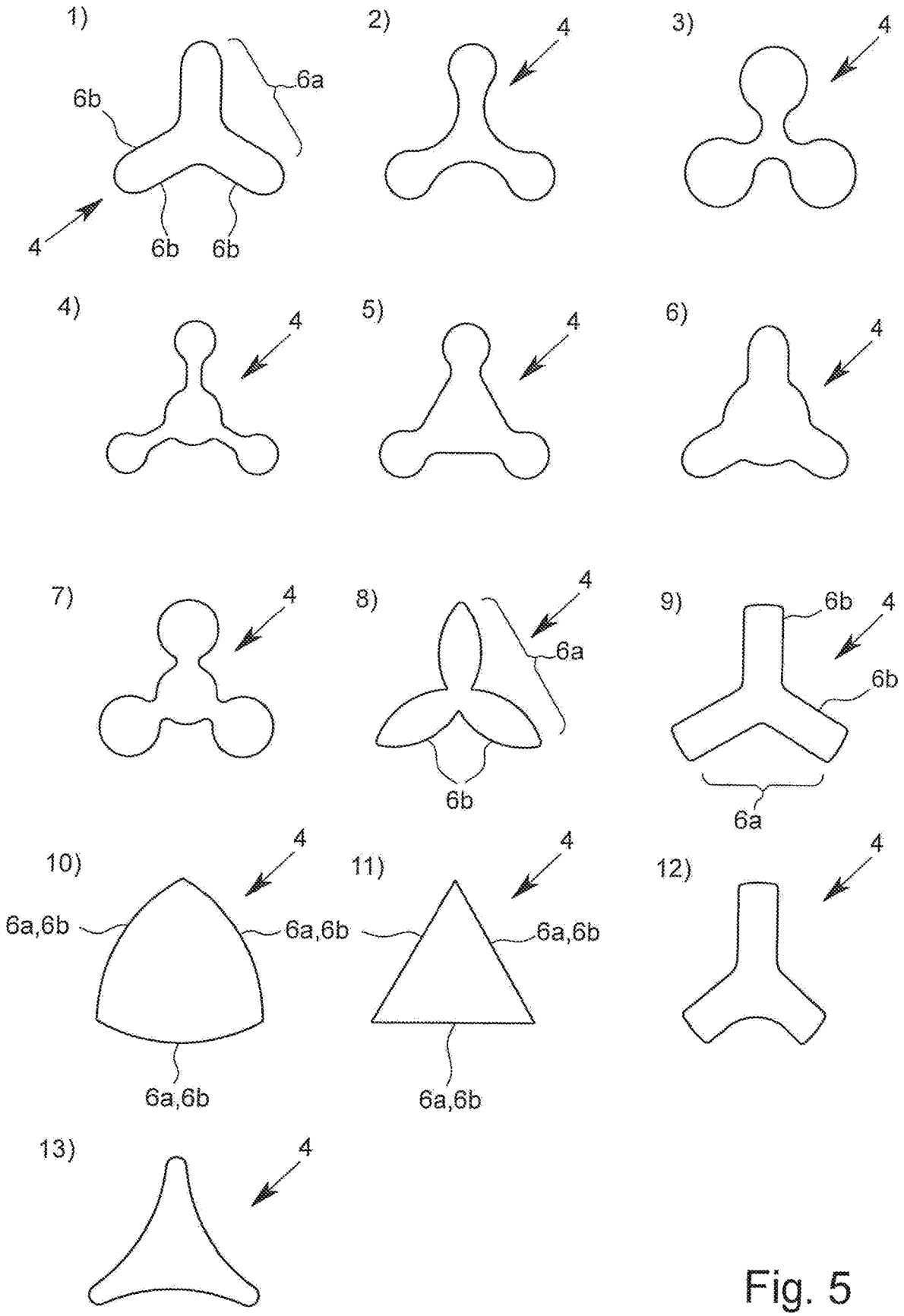
FIG. 5 shows schematic top views of further nubs in accordance with the invention.

Furthermore, it is understood that this can also be realized when using a different nub shape. Other triaxial nub shapes of the nub base 10 of the nub 4 are represented by FIG. 5 and denoted as variant embodiments 1 to 13. The arrangement of these possible nub shapes on the carrier plate 2 can be embodied such that the aforementioned continuous straight lines do not occur on the carrier plate 2. The triaxial embodiments 1 to 13 of FIG. 5 each exhibit at least three leg sides 6*b*, while it is understood that the long side 6*a* is formed by at least one leg side. It is not shown that the variant embodiments 1 to 13 may have an undercut 8 in the area of the long side and/or that the shaping 8 may extend for at least 40% of the long side 6*a* and/or along the leg side 6*b*.

Figure 6:
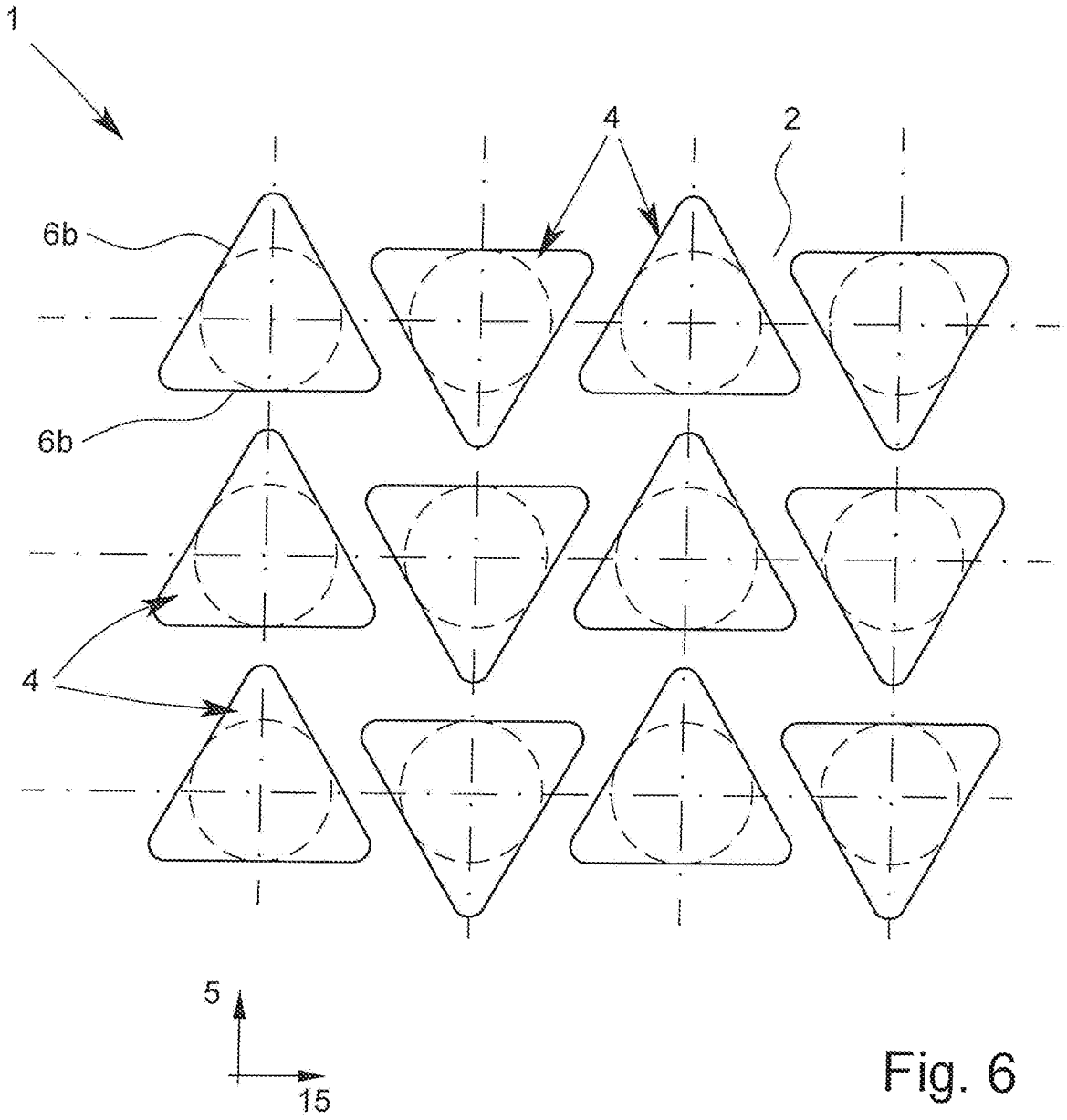
FIG. 6 shows a schematic top view of another variant embodiment of a decoupling sheet in accordance with the invention.

FIG. 6 shows that, when using a triangular nub shape for the nub base 10 of the nub 4, an arrangement on the carrier plate 2 is provided such that no continuous straight line of the channel segment of adjacent nubs 4 results on the carrier plate 2. The center points of the nubs 4 and/or the nub bases 10 per FIG. 3 are arranged on straight lines running parallel to the lengthwise direction 5 and on lines running parallel to the transverse direction 15.

Also in the triaxial configuration of the nub base 10 in accordance with the invention in FIGS. 3 and 4, these nubs 4 are arranged on the carrier plate 2 such that an arrangement per FIG. 1 is produced, wherein the nubs 4 are arranged running in rows in the lengthwise direction 5 and in the transverse direction 15. The center points of the nubs 4 running in the lengthwise direction 5 are arranged on a line running at least substantially parallel to the lengthwise direction 5. In addition, the center points of the nubs 4 running transversely to the lengthwise direction 5 are arranged on a line running at least substantially perpendicular to the lengthwise direction 5 and thus in the transverse direction 15. This arrangement of the nubs 4 produces a symmetrical series of nubs within the respective row, wherein this arrangement in particular makes it possible for the aforementioned continuous straight lines and/or weakening lines not to occur on the carrier plate 2.

However, not only are the center points of the nubs 4 and/or the nub bases 10 arranged in rows on the decoupling sheet 1 of FIG. 1, but also the arrangement is such that the nubs 4 arranged in succession in a row running at least substantially parallel to the lengthwise direction 5 extend in such a way that the shorter leg 13 of the nubs 4 is oriented in the lengthwise direction 5. In an immediately adjacent row running at least substantially parallel to the lengthwise direction 5, the nubs 4 arranged in succession are oriented such that the shorter leg 13 of the nubs 4 is oriented opposite to the lengthwise direction 5. This results in an alternating nub orientation in a row running at least substantially parallel to the transverse direction 15.

For the arrangement of the decoupling sheet 1 on an ground 18, a connection means 17 is provided per FIG. 2. This connection means 17 is placed on the outside 16 of the nub bases 10. In the exemplary embodiment shown, the connection means 17 is secured to the outside 16 of the nub bases 10. A nonwoven was used as the connection means 17 in the exemplary embodiment shown. It is understood that in further variant embodiments (not shown), one could also use a textile and/or paper and/or a scrim and/or a lattice. The connection means 17 is provided with a lattice-like configuration in the exemplary embodiment shown. In an embodiment (not shown), besides the lattice-like formation, a formation is also possible over the entire surface.

Furthermore, the nub 4 of FIG. 2 has a height of 3 mm. In further embodiments, which are not shown graphically, a height between 1 and 4 mm, further preferably between 2.5 and 3.5 mm, is provided. Further, the clear gap 19 between adjacent nubs 4 in the exemplary embodiment shown is greater than 2 mm. The clear gap 19 between the nubs 4 varies on the decoupling sheet 1 of FIG. 1, so that a clear gap 19 between roughly 3 mm and 9 mm can be provided, preferably between 4 and 8 mm, further preferably between 5 and 6 mm. Moreover, FIG. 1 shows that the ratio between the area of the nub bases 10 of all the nubs 4 and the area of the carrier plate 2 is at least substantially around 50%. In further embodiments, the ratio can be between 40% and 70%, preferably between 45% and 55%.

Moreover, FIG. 2 shows that tiles 23 are provided on top of the carrier plate 2. Joints 24 result between adjacent tiles 23. For connecting the tiles 23 to the decoupling sheet 1, a tile adhesive is provided, which is applied both in the nub interior space 20 and on the carrier plate 2. It catches inside the undercut 8 and/or penetrates into the protrusion 9. Regardless of the orientation of the decoupling sheet 1 on an ground 18, the joints 24 between the tiles 23 do not coincide with a weakening line and/or a continuous line on the carrier plate 2. The possible continuous line produced between two nubs 4 cannot continue across adjacent nubs 4.

In further exemplary embodiments per FIGS. 7 to 13, it is provided that protrusions 21*a*, 21*c* and/or recesses 21*b*, 21*d* may be present both on the nub base 10 and on the carrier plate 2. It is understood that recesses 21*b*, 21*d* are respectively provided between adjacent protrusions 21*a*, 21*c*. In the end, basically one recess is adjacent to a protrusion 21*a*, 21*c* and/or recess 21*b*, 21*d*.

Figure 7:
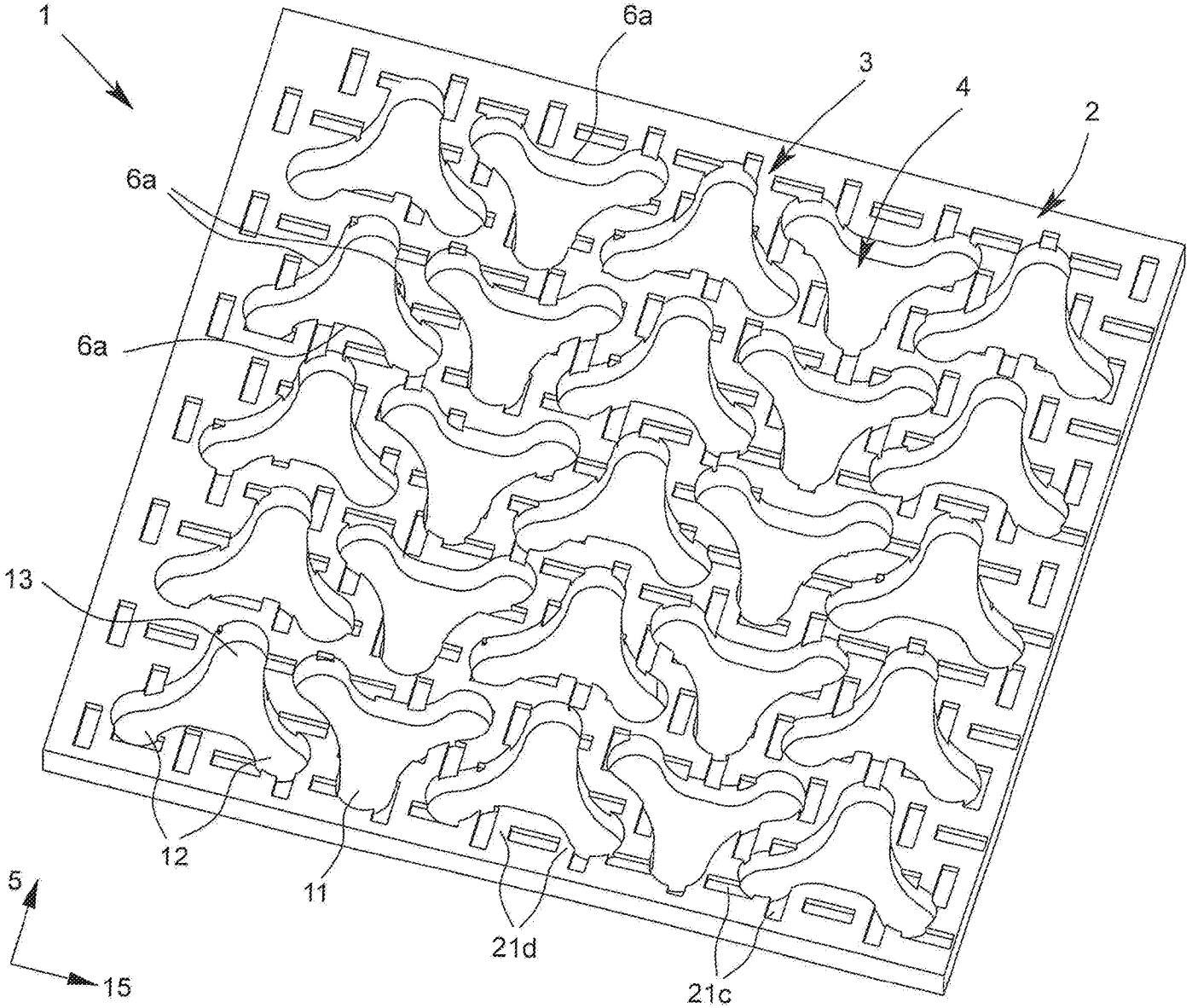
FIG. 7 shows a perspective schematic view of a further embodiment of a decoupling sheet according to the invention.
Figure 8:
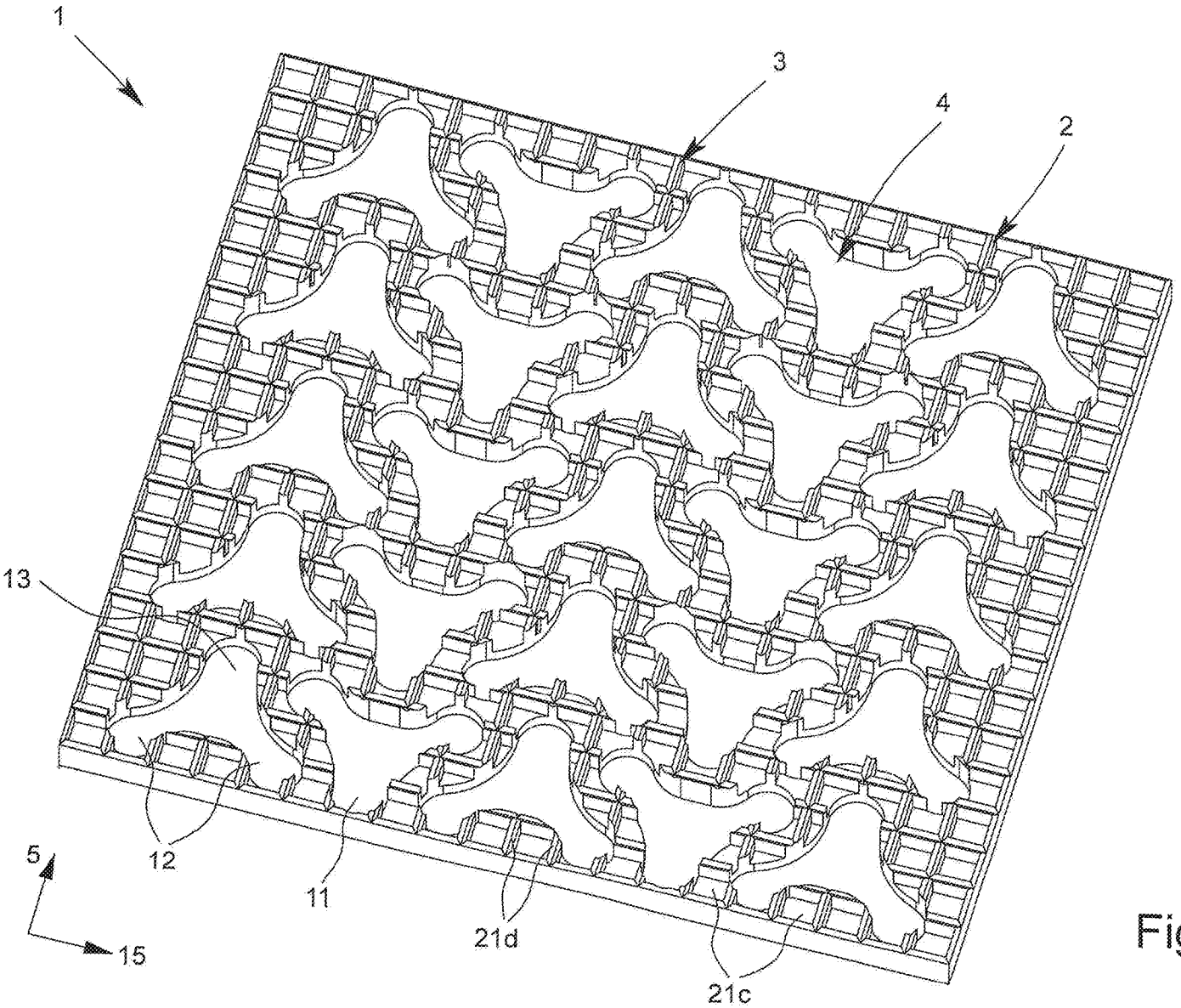
FIG. 8 shows a perspective schematic view of another embodiment of a decoupling sheet according to the invention.
Figure 9:
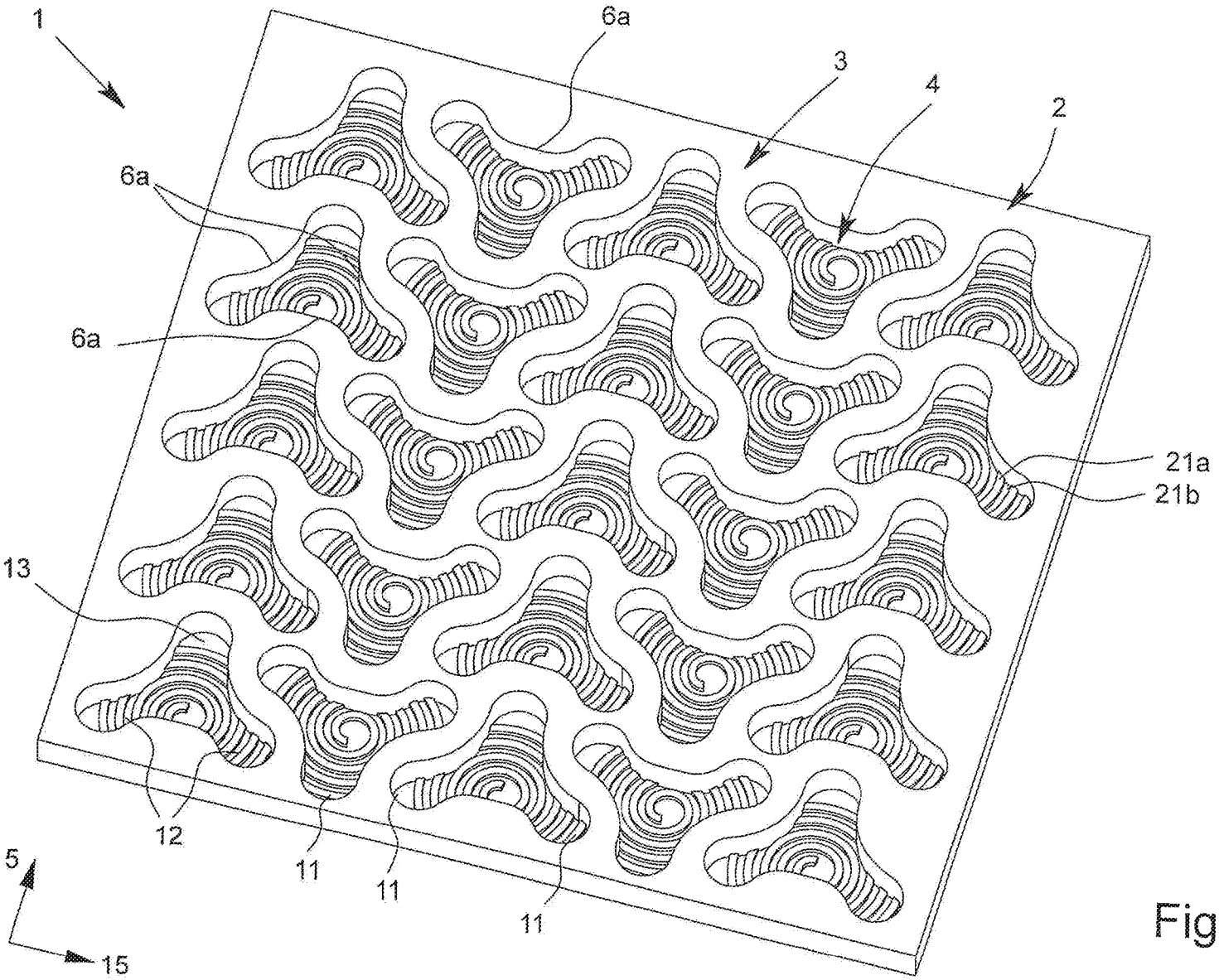
FIG. 9 shows a perspective schematic view of another embodiment of a decoupling sheet according to the invention.
Figure 10:
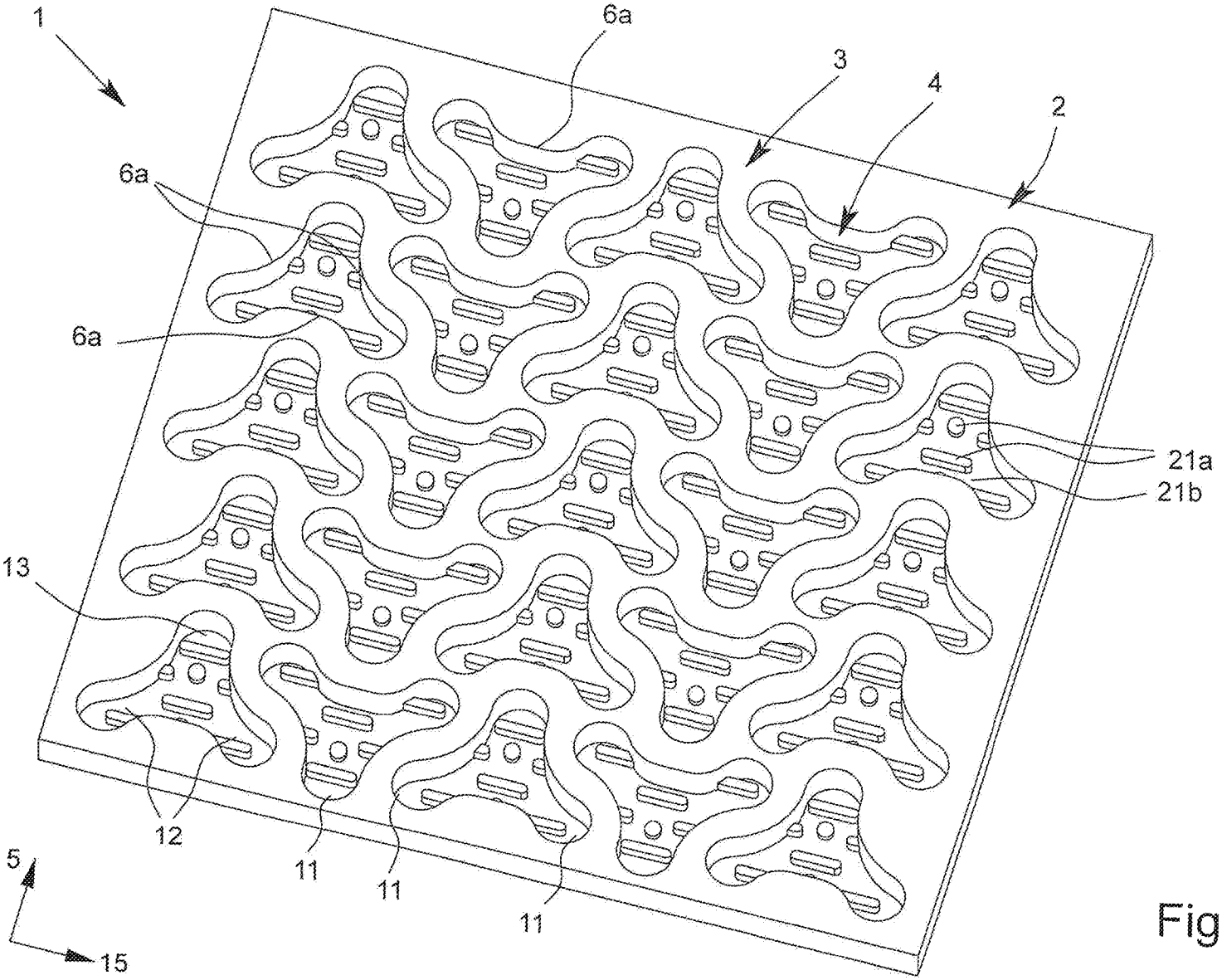
FIG. 10 shows a perspective schematic view of another embodiment of a decoupling sheet according to the invention.
Figure 11:
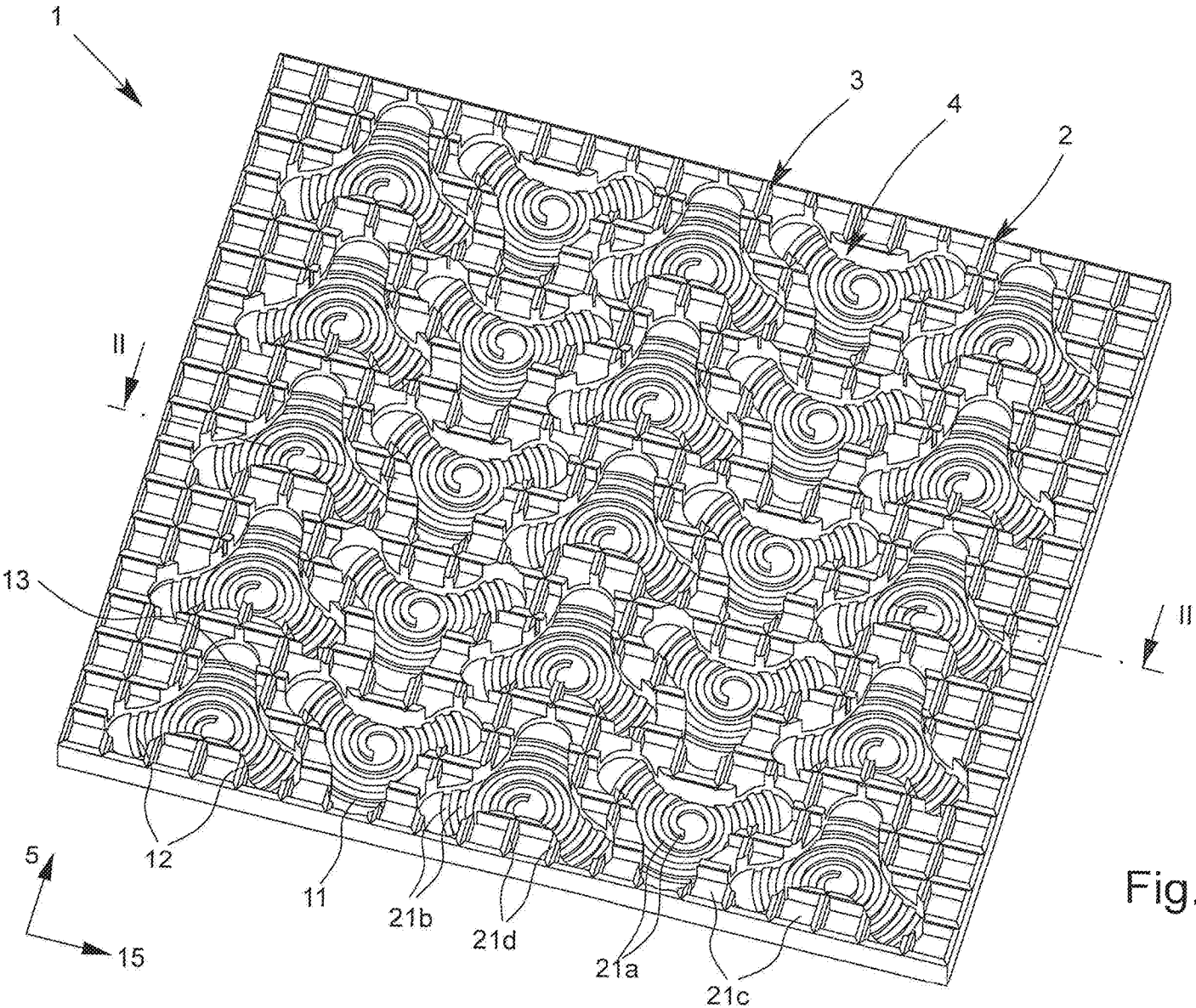
FIG. 11 shows a perspective schematic view of another embodiment of a decoupling sheet according to the invention.
Figure 12:
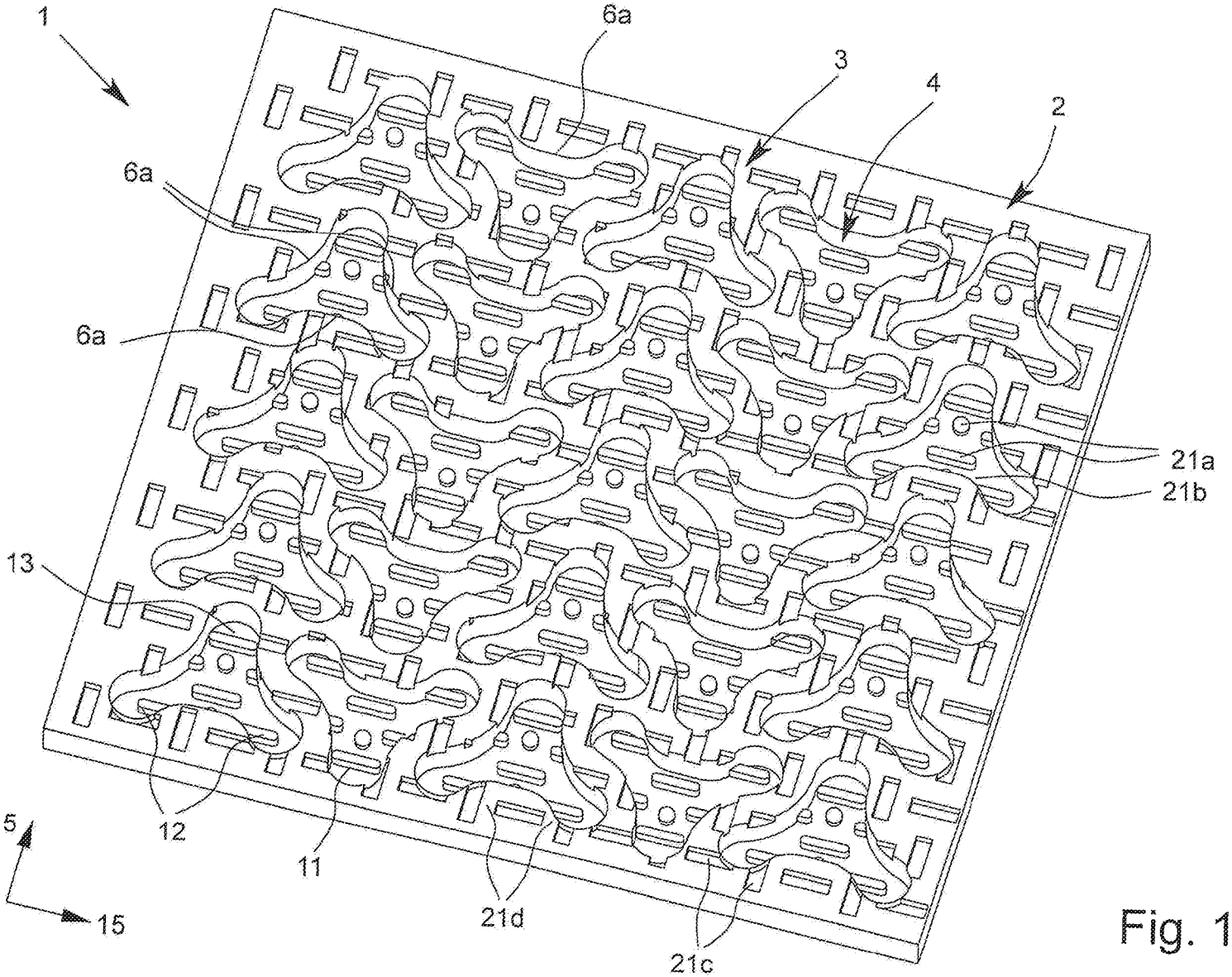
FIG. 12 shows a perspective schematic view of another embodiment of a decoupling sheet according to the invention.

FIGS. 7 to 12 show a carrier plate 2 and nubs 4, wherein the nub interior space 20 is open toward the carrier plate 2. On the side of the nub base 10 facing toward the nub interior space 20 in FIGS. 9 to 11 the protrusions 21*a* and/or recesses 21*b* may be provided. In the exemplary embodiments shown, the protrusions 21*a* in FIGS. 9 to 11 are provided on all nub bases 10 shown for the decoupling sheet 1. It is to be understood, however, that in one exemplary embodiment (not shown), only at least one nub 4 has at least one protrusion 21*a* and/or recess 21*b*. A perforation of the carrier plate 2 with the protrusions 21*c* and/or recesses 21*d* is shown in the exemplary embodiment of FIGS. 7 to 8 and FIGS. 11 to 12. Here, the protrusions 21*c* are provided on the side facing toward the nub interior space 20. Accordingly, recesses are provided on the side of the carrier plate 2 facing away from the nub interior space 20 and/or the nub base 10, corresponding to the protrusions 21*c*. In the end, it is understood that on the side of the carrier plate 2 facing toward the nub interior space 20 a recess 21*d* may be provided next to each protrusion 21*c*. In the exemplary embodiments, a plurality of protrusions 21*c* is provided on the carrier plate 2. It is to be understood that in further exemplary embodiments that are not shown, at least one protrusion 21*c* can be provided on the carrier plate 2.

The protrusions 21*a*, 21*c* and/or recesses 21*b*, 21*d* may take on various geometrical shapes and structures. For example, several of the depicted embodiments shall be explained in the following. In the end, it is understood here that in the end different protrusions 21*a*, 21*c* with different structures may be provided according to the invention in other embodiments (not shown). In the end, it is decisive for the protrusions 21*c* and/or recesses 21*b* that the tile adhesive for connecting the tiles 23 to the decoupling sheet 1 can penetrate into the protrusions 21*c* and/or recesses 21*b* and fill them up almost completely. This is illustrated with the aid of FIG. 13.

In the embodiments shown, a multitude and/or plurality of protrusions 21*a*, 21*c* and/or recesses 21*b*, 21*d* are provided either on the carrier plate 2 or on the nub base 10 or on both. The protrusion 21*a* on the nub base 10 is formed in the shape of a spiral and/or an arc segment according to FIGS. 9 and 11. This spiral trend of the protrusion 21*a* emerges from the middle region 7 of the nub base 10. A multitude of protrusions 21*a* per FIG. 10 may be provided not only on the nub base 10 itself, but also on the leg bottom 22 of a leg 12, 13.

Not shown is that in a further embodiment the protrusions 21*a*, 21*c* and/or the recesses 21*b*, 21*d* are arranged in an irregular manner and/or unordered manner on the carrier plate 2 and/or the nub base 10, wherein in particular they have different shapes and/or structures. In the end, the protrusions 21*a*, 21*c* and/or recesses 21*b*, 21*d* act to produce a structured surface of the nub base 10 and/or the carrier plate 2.

Per FIG. 8, the protrusions 21*c* of the carrier plate 2 have a shaping designed to create an undercut. In a further embodiment (not shown), it is provided that the protrusions 21*a* and/or the recesses 21*b* of the nub base 10 also have a shaping to create an undercut.

Moreover, in another embodiment (not shown), it is provided that the protrusions 21*a*, 21*c* and/or the recesses 21*b*, 21*d* have a height and/or a depth greater than 1 μm, preferably greater than 100 μm, further preferably between 100 and 1000 μm and especially between 300 and 500 μm.

In the end, it is understood that the protrusions 21*a* and/or recesses 21*b* of the nub base 10 may also merge directly into the protrusions 21*c* and/or recesses 21*d* of the carrier plate 2, wherein in particular the structure and/or shape of the protrusions 21*a*, 21*c* and/or the recesses 21*b*, 21*d* can be interrupted when the carrier plate 2 has a recess on account of the nub 4 and/or when the carrier plate 2 merges into the nub 4. It is also understood that the protrusions 21*a* and/or the recesses 21*b* on the nub base 10 interrupt its geometrical structure, especially when the nub wall of the nub 4 merges into the protrusion 21*a* and/or the recess 21*b* of the nub base 10.

FIG. 9 shows that protrusions 21*a* in the shape of an arc section are provided on the leg bottom 22 concentrically to the middle region 7 around the center point of the nub 4.

FIG. 10 shows a further geometrical shape of the protrusions 21*a*, wherein the protrusions 21*a* are formed on the nub base 10 web-like and/or at least substantially rectangular-shaped and/or elliptical-shaped. The protrusions 21*a* on the nub base 10, being web-like and/or at least substantially rectangular-shaped and/or elliptical-shaped are provided per FIG. 10 transversely and/or longitudinally to the lengthwise direction 5 of the carrier plate 2.

In addition, FIG. 7 shows that a plurality of protrusions 21*c* and/or recesses 21*d* is present on the carrier plate 2 in the exemplary embodiment shown, wherein the protrusions 21*c* are arranged in rows running transversely to the lengthwise direction 5 of the carrier plate 2. FIG. 7 represents web-like and/or rectangular-shaped protrusions 21*c* on the carrier plate 2. The elongated protrusions 21*c* shown in FIG. 7 extend with their lengthwise dimension solely transversely and/or longitudinally to the lengthwise direction 5 of the carrier plate 2. The protrusions 21*c* in the exemplary embodiment of FIG. 7 are arranged in a row with alternating orientation, running longitudinally and/or transversely to the lengthwise direction 5 of the carrier plate 2.

FIG. 8 shows that the protrusions 21*c* are formed rectangular-shaped. In an embodiment (not shown), the protrusions 21*c* of the carrier plate 2 are formed elliptical-shaped. In the end, it is understood that recesses 21*d* may also have the geometrical shapes of the protrusions 21*c*.

Figure 13:
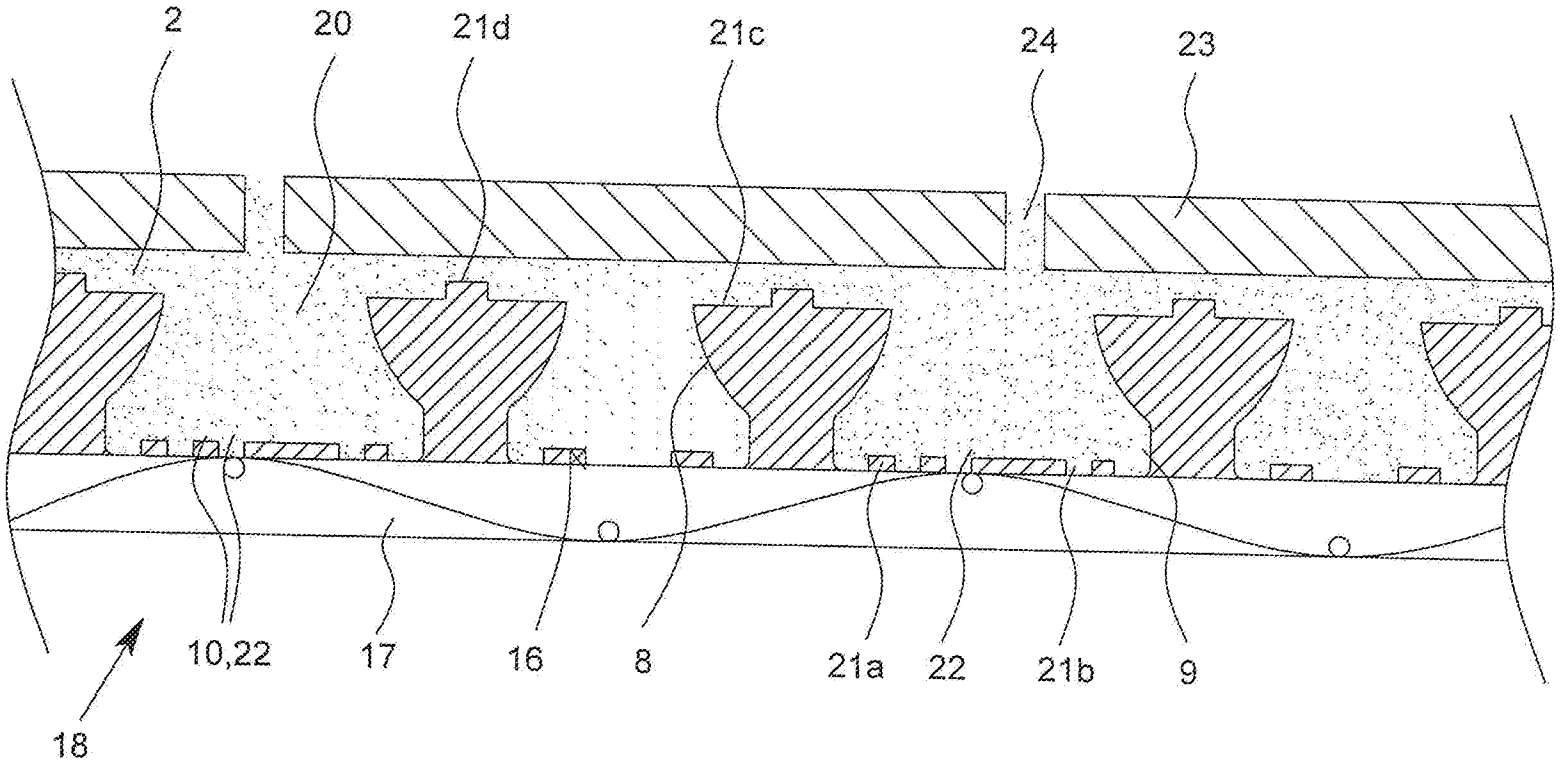
FIG. 13 shows a schematic cross-sectional view of a decoupling sheet according to the invention along line II-II of FIG. 11.

FIG. 13 shows a cross sectional view along section II-II of FIG. 11, wherein it illustrates that the recesses 21*b* are arranged on the nub base 10 on a connection means 17, wherein the tile adhesive for connecting the tiles 23 to the decoupling sheet 1 and/or the carrier plate 2 penetrates into the protrusions 21*c* of the carrier plate 2 and/or into the recesses 21*b* of the nub 4.

Moreover, a method is also provided for the production of a decoupling sheet 1 in the exemplary embodiment shown, wherein the decoupling sheet 1 comprises a carrier plate 2 and a plurality of nubs 4 protruding from the carrier plate 2, wherein adjacent nubs 4 are provided transversely to the lengthwise direction 5 of the carrier plate 2 and in the lengthwise direction 5 of the carrier plate 2 per FIG. 1 and per FIGS. 6 to 12. It is provided, according to the embodiments shown, that the nub bases 10 of immediately adjacent nubs 4 are triaxial in shape. In accordance with FIGS. 7 to 13, it is provided in a further embodiment of the method that in the side of the nub base 10 of at least one nub 4 facing toward the nub interior space 20 at least one protrusion 21*a* and/or recess 21*b* is placed and/or that in the side of the carrier plate 2 facing toward the nub interior space 20 at least one protrusion 21*c* and/or recess 21*d* is placed. The protrusions 21*a*, 21*c* placed into the nub base 10 and/or the carrier plate 2 is illustrated by FIGS. 7 to 12.

In an embodiment (not shown), it is provided that the protrusions 21*a*, 21*c* and/or recesses 21*b*, 21*d* are made by a laser method, a plasma method, a mechanical method, and/or by embossing during and/or after the production of the decoupling sheet 1, wherein the protrusion 21*a*, 21*c* and/or the recess 21*b*, 21*d* is placed in the carrier plate 2 and/or into the nub 4 on the nub base 10.

LIST OF REFERENCE NUMBERS

1 Decoupling sheet
2 Carrier plate
3 Carrier plate plane
4 Nubs
5 Lengthwise direction
6*a* Long side of nub
6*b* Leg side of nub
7 Middle region
8 Undercut/shaping
9 Protrusion to form the undercut
10 Nub base
11 End region
12 Leg
13 Short leg
14 Leg length
15 Transverse direction
16 Outside of nub base

17 Connection means
18 Ground
19 Clear gap
20 Nub interior space
21*a* Protrusion of nub
21*b* Recess of nub
21*c* Protrusion of carrier plate
21*d* Recess of carrier plate
22 Leg bottom
23 Tile
24 Joint

The invention claimed is:

1. A decoupling sheet comprising:

a carrier plate and a plurality of nubs protruding from a carrier plate plane, wherein nubs of the plurality of nubs are arranged transversely to a lengthwise direction and nubs of the plurality of nubs are arranged in the lengthwise direction of the carrier plate, wherein the plurality of nubs each include a nub base which is in a triaxial shape having at least three leg sides, wherein emerging from a middle region of each nub are three spaced-apart legs, wherein each of the three spaced-apart legs define a leg axis and a leg length such that an angle between adjacent ones of said leg axes is at least 90° and wherein the leg length of one of the three spaced-apart legs is less than the leg length of two other leg lengths, wherein the nubs arranged transversely to the lengthwise direction of the carrier plate are arranged such that on the carrier plate no continuous straight line running transversely to the lengthwise direction of the plate is formed, and wherein the nubs arranged in the lengthwise direction of the carrier plate are arranged such that on the carrier plate no continuous straight line running in the lengthwise direction of the carrier plate is formed.

2. The decoupling sheet according to claim 1, wherein at least one nub with three long sides is provided having a triaxial nub base and a middle region of the triaxial nub base is defined by a circle in which the three long sides contact the circle tangentially.

3. The decoupling sheet according to claim 2, wherein the plurality of nubs and/or the triaxial nub base has mirror symmetry with respect to a center axis running at least substantially parallel to the lengthwise direction and an angle of a leg axis of a shorter leg with respect to a leg axis of an adjacent leg is greater than 120°.

4. The decoupling sheet according to claim 1, wherein the plurality of nubs each have a concave shape on at least one long side.

5. The decoupling sheet according to claim 1, wherein in a region of a long side of at least one nub with three long sides and/or a leg side of the three leg sides at least one shaping, including a sickle, an arc segment, or a crescent, is provided to form an undercut on an interior of the nubs, wherein the shaping is further formed by a protrusion protruding out from the nubs.

6. The decoupling sheet according to claim 5, wherein the protrusion is provided in the region of the nub base, and merges directly into the nub base and the shaping extends for at least 40% of the long side and/or the leg side.

7. The decoupling sheet according to claim 5, wherein an end region resulting from two converging long sides of at least one nub with three long sides is free of undercuts and/or the nubs are formed at least at one end region resulting from the two converging long sides being rounded and without corners and/or a radius of a long side is multiple times longer than a radius of an end region, wherein a radius of a long side is twice as large as a radius of an end region.

8. The decoupling sheet according to claim 1, wherein nubs of the plurality of nubs running longitudinally and transversely to the lengthwise direction of the carrier plate are arranged on the carrier plate such that no continuous straight line running at a slant to the lengthwise direction of the carrier plate is formed.

9. The decoupling sheet according to claim 1, wherein the plurality of nubs are arranged in rows running in the lengthwise direction and the transverse direction, wherein center points of the nubs running in the lengthwise direction are arranged on a line running at least substantially parallel to the lengthwise direction and/or the center points of the nubs running transversely to the lengthwise direction are arranged on a line running at least substantially perpendicular to the lengthwise direction.

10. The decoupling sheet according to claim 1, wherein the shorter leg of the three spaced-apart legs of the nubs arranged in a row of successively arranged nubs arranged at least substantially parallel to the lengthwise direction is oriented in the lengthwise direction and the shorter leg of the nubs arranged in an immediately adjacent row of successively arranged nubs running at least substantially parallel to the lengthwise direction is oriented opposite to the lengthwise direction.

11. The decoupling sheet according to claim 1, wherein on an outside of the nub bases, a flat connection portion is provided to connect the plurality of nubs to a ground surface, wherein the portion is a nonwoven and/or a textile and/or paper and/or a scrim and/or a lattice, and the portion extends across an entire surface of the outside of the nub bases and/or is in a lattice shape across at least a portion of the nub bases.

12. The decoupling sheet according to claim 1, wherein the plurality of nubs have a height between 1 and 5 mm, and/or a clear gap between the adjacent nubs is greater than 2 mm, and/or a ratio of an area of nub bases of the plurality of nubs to an area of the carrier plate is between 40% and 70%.

13. The decoupling sheet according to claim 1, wherein on a side of a nub base of at least one nub facing toward a nub interior space of the at least one nub at least one protrusion and/or one recess is provided and/or on a side of the carrier plate facing toward the nub interior space at least one protrusion and/or recess is provided, wherein the protrusion and/or the recess on the nub and/or the protrusion and/or the recess on the carrier plate has a height and/or a depth greater than 1 μm.

14. The decoupling sheet according to claim 13, wherein the protrusions and/or the recesses form a structured surface of the nub base and/or of the carrier plate and/or the protrusions and/or recesses comprise different shapes and/or structures and/or the protrusions and/or the recesses are arranged in a non-uniform pattern on the carrier plate and/or on the nub base and/or at least one protrusion and/or at least one recess comprises at least one shaping in form of a sickle, an arc segment, or a crescent, to form an undercut.

15. The decoupling sheet according to claim 1, wherein a protrusion and/or a recess on the nub base is in the shape of a spiral, or an arc segment, and/or a spiral protrusion and/or recess is provided in the middle region of the nub base, and/or a plurality of protrusions and/or recesses are provided on the nub base, and/or a multitude of protrusions and/or recesses are provided on a leg base of a leg, and/or protrusions and/or recesses in the shape of an arc segment are provided concentrically to the middle region and/or about a center point of the nub on a leg bottom, and/or the protrusions and/or recesses of the nub base are formed web-shaped, rectangular-shaped or elliptical-shaped.

16. The decoupling sheet according to claim 1, wherein web-shaped and/or rectangular-shaped and/or elliptical-shaped formed protrusions and/or recesses on the nub base are oriented transversely and/or longitudinally to the lengthwise direction of the carrier plate.

17. The decoupling sheet according to claim 1, wherein the plurality of protrusions and/or recesses are provided on the carrier plate and the protrusions and/or recesses are arranged in rows running longitudinally and transversely to the lengthwise direction of the carrier plate.

18. The decoupling sheet according to claim 1, wherein a plurality of protrusions and/or recesses of the earlier plate are web-shaped, rectangular-shaped or elliptical-shaped.

19. The decoupling sheet according to claim 1, wherein the plurality of protrusions and/or recesses of the carrier plate are elongated and oriented by a longitudinal extension solely transversely and/or longitudinally to the lengthwise direction of the carrier plate and/or the protrusions and/or recesses running in a row transversely and/or longitudinally to the lengthwise direction of the carrier plate are arranged in an alternating orientation.

* * * * *